US012146233B2

(12) United States Patent
Li et al.

(10) Patent No.: US 12,146,233 B2
(45) Date of Patent: Nov. 19, 2024

(54) METHODS OF HYDROGENATING CARBON DIOXIDE USING ELECTROCHEMICAL CELLS COMPRISING TUNABLE CATALYSTS

(71) Applicant: Battelle Energy Alliance, LLC, Idaho Falls, ID (US)

(72) Inventors: Meng Li, Ammon, ID (US); Bin Hua, Ammon, ID (US); Dong Ding, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 0 days.

(21) Appl. No.: 17/445,685

(22) Filed: Aug. 23, 2021

(65) Prior Publication Data

US 2022/0056596 A1 Feb. 24, 2022

Related U.S. Application Data

(60) Provisional application No. 62/706,510, filed on Aug. 21, 2020.

(51) Int. Cl.
*C25B 3/26* (2021.01)
*C25B 1/23* (2021.01)
(Continued)

(52) U.S. Cl.
CPC ..... *C25B 3/26* (2021.01); *C25B 1/23* (2021.01); *C25B 1/50* (2021.01); *C25B 3/03* (2021.01);
(Continued)

(58) Field of Classification Search
None
See application file for complete search history.

(56) References Cited

U.S. PATENT DOCUMENTS 5,336,655 A 8/1994 Basini et al.
5,855,815 A 1/1999 Park et al.
(Continued)

FOREIGN PATENT DOCUMENTS

CN 101362080 A 2/2009
WO 2019/215630 A2 11/2019
WO 2020/245621 A1 12/2020

OTHER PUBLICATIONS

Kortlever et al. (J. Phys. Chem. Lett. 2015, 6, 4073-4082). (Year: 2015).*

(Continued)

*Primary Examiner* — Wojciech Haske
(74) *Attorney, Agent, or Firm* — TraskBritt

(57) ABSTRACT

A method of hydrogenating carbon dioxide comprises forming a tunable catalyst comprising at least one metal comprising a size within a range of from a single atom to about 999 nanometers and formulated to produce one or more carbon-containing compounds. An electrochemical cell comprising a positive electrode, a negative electrode comprising the tunable catalyst, and an electrolyte between the positive electrode and the negative electrode is formed. Carbon dioxide is introduced to the negative electrode of the electrochemical cell and a potential difference is applied between the positive electrode and the negative electrode to selectively hydrogenate the carbon dioxide. The hydrogen ions are diffused through the electrochemical cell. The carbon dioxide at the negative electrode is hydrogenated to selectively form carbon monoxide, methane, or a desired ratio of carbon monoxide and methane. An electrochemical cell and a carbon dioxide hydrogenation system are also disclosed.

11 Claims, 30 Drawing Sheets

(51) Int. Cl.

| | |
|---|---|
| ***C25B 1/50*** | (2021.01) |
| ***C25B 3/03*** | (2021.01) |
| ***C25B 9/17*** | (2021.01) |
| ***C25B 11/052*** | (2021.01) |
| ***C25B 11/054*** | (2021.01) |
| ***C25B 11/067*** | (2021.01) |
| ***C25B 11/069*** | (2021.01) |
| ***C25B 11/081*** | (2021.01) |

(52) U.S. Cl.
CPC ..... *C25B 9/17* (2021.01); *C25B 11/052* (2021.01); *C25B 11/069* (2021.01); *C25B 11/081* (2021.01)

(56) References Cited

U.S. PATENT DOCUMENTS

| | | | |
|---|---|---|---|
| 7,410,717 | B2 | 8/2008 | Moon et al. |
| 9,556,075 | B2 | 1/2017 | Deville et al. |
| 10,529,975 | B2 | 1/2020 | Song et al. |
| 2009/0005238 | A1 | 1/2009 | Falaras |
| 2009/0090626 | A1 | 4/2009 | Holt et al. |
| 2011/0005921 | A1 | 1/2011 | Brault |
| 2011/0135945 | A1 | 6/2011 | Monredon-Senani et al. |
| 2011/0259244 | A1 | 10/2011 | Herbig et al. |
| 2017/0313584 | A1 | 11/2017 | Mamedov |
| 2019/0040535 | A1 | 2/2019 | MacFarlane et al. |
| 2021/0024439 | A1 | 1/2021 | Radaelli et al. |
| 2021/0170369 | A1 | 6/2021 | Jiang et al. |

OTHER PUBLICATIONS

Li et al. (Angew. Chem. Int. Ed. 2017, 56, 10761-10765). (Year: 2017).*
Jimenez et al. (Applied Catalysis B: Environmental 107 '2011' 210-220). (Year: 2011).*
Aitbekova et al., "Low-Temperature Restructuring of CeO2-Supported Ru Nanoparticles Determines Selectivity in CO2 Catalytic Reduction," J. Am. Chem. Soc., vol. 140, (2018), pp. 13736-13745.
Bai et al., "Highly Active and Selective Hydrogenation of CO2 to Ethanol by Ordered Pd—Cu Nanoparticles," J. Am. Chem. Soc., vol. 139, (2017), pp. 6827-6830.
Basbus et al., "Revisiting the Crystal Structure ofBaCe0.4Zr0.4Y0.203-d Proton Conducting Perovskite and Its Correlation with Transport Properties," ACS Appl. Energy Mater., vol. 3, (2020), pp. 2881-2892.
Capdevila-Cortada, Ammonia Synthesis, "Electrifying the Haber-Bosch," Nature Catalysis, vol. 2, (Dec. 2019), pp. 1055.
Chen et al., "Aqueous CO2 Reduction at Very Low Overpotential on Oxide-Derived Au Nanoparticles," J. Am. Chem. Soc., vol. 134, (2012), pp. 19969-19972.
Cored et al., "Hydrothermal Synthesis of Ruthenium Nanoparticles with a Metallic Core and a Ruthenium Carbide Shell for Low-Temperature Activation of CO2 to Methane," J. Am. Chem. Soc., vol. 141, (2019), pp. 19304-19311.
Fabbri et al., "Materials Challenges Toward Proton-Conducting Oxide Fuel Cells: a Critical Review," Chem. Soc. Rev., vol. 39, (2010), pp. 4355-4369.
Fan et al., "Strategies in Catalysts and Electrolyzer Design for Electrochemical CO2 Reduction Toward C2+ Products," Sci. Adv., vol. 6, eaay3111, (Feb. 21, 2020), pp. 1-17.
Gao et al., "Rational Catalyst and Electrolyte Design for CO2 Electroreduction Towards Multicarbon Products," Nature Catalysis, vol. 2, (Mar. 2019), pp. 198-210.
Jing et al., "Structural Evolution of Ag—Pd Bimetallic Nanoparticles through Controlled Galvanic Replacement: Effects of Mild Reducing Agents," Chem. Mater., vol. 27, (2015), pp. 2172-2180.
Jolivet et al., "Design of Oxide Nanoparticles by Aqueous Chemistry," J. Sol-Gel. Sci. Technol., vol. 46, (2008), pp. 299-305.
Kyriakou et al., "An Electrochemical Haber-Bosch Process," Joule, vol. 4, (Jan. 15, 2020), pp. 142-158.
Li et al., "Electroreduction of Carbon Monoxide to Liquid Fuel on Oxide-Derived Nanocrystalline Copper," Nature, vol. 508, (Apr. 24, 2014), 17 pages.
Liu et al., "Noble Metal-Metal Oxide Nanohybrids With Tailored Nanostructures for Efficient Solar Energy Conversion, Photocatalysis and Environmental Remediation," Energy & Environ. Sci., vol. 10, (2017), pp. 402-434.
Nahar, "Sol-Gel Chemistry: An Advanced Technique to Produce Macroscopic Nanostructures of Metal and Semiconductor Colloids," Virginia Commonwealth University Theses and Dissertations, (2017), 216 pages.
Niwa et al., "The Effect of Lanthanide Oxides as a Support for Ruthenium Catalysts in Ammonia Synthesis," Journal of Catalysis, vol. 162, (1996), pp. 138-142.
Pudukudy et al., "Methane Decomposition Over Ni, Co and Fe Based Monometallic Catalysts Supported on Sol Gel Derived SiO2 Microflakes," Chem. Eng. J., vol. 262, (2015), pp. 1009-1021.
Saito et al., "Synergistic Effect of MgO and CeO2 as a Support for Ruthenium Catalysts in Ammonia Synthesis," Catalysis Letters, vol. 106, Nos. 3-4, (Feb. 2006), pp. 107-110.
Smith et al., "Current and Future Role of Haber-Bosch Ammonia in a Carbon-Free Energy Landscape," Energy & Environ. Sci., vol. 13, (2020), pp. 331-344.
Van Deelen et al., "Control of Metal-Support Interactions in Heterogeneous Catalysts to Enhance Activity and Selectivity," Nature Catalysis, vol. 2, (Nov. 2019), pp. 955-970.
Wang et al., "CO2 Hydrogenation to Formate and Methanol as an Alternative to Photo-and Electrochemical CO2 Reduction," Chem. Rev., vol. 115, (2015) pp. 12936-12973.
Zhang et al., "Selective Hydrogenation over Supported Metal Catalysts: From Nanoparticles to Single Atoms," Chem. Rev., vol. 120, (2020), pp. 683-733.
Ahmad ("Nanostructured cerium oxide (Ceria): Electrolyte for IT-SOFC." Int J Nano Rech 1.1 (2018): 11.) (Year: 2018).
Gonzalez et al. ("Physicochemical characterization of Pt and Ir particles deposited on Ce (1-x) Ru (x) O2 solid-solutions for CO oxidation." MRS Advances 4.61 (2019): 3433-3440.) (Year: 2019).
Triki et al. ("Ruthenium catalysts supported on TiO2 prepared by sol-gel way for p-hydroxybenzoic acid wet air oxidation." Journal of sol-gel science and technology 48.3 (2008): 344-349.) (Year: 2008).
Deganello et al. ("Phase analysis and oxygen storage capacity of ceria-lanthana-based TWC promoters prepared by Sol-Gel routes." Journal of Solid State Chemistry 163.2 (2002): 527-533.). (Year: 2002).
Guo et al, "Performance and durability of a layered proton conducting solid oxide fuel cell fueled by the dry reforming of methane", Sep. 13, 2017, RSC Advances, vol. 7, pp. 44319-44325. (Year: 2017).
Naeem et al. (Exsolution of Metallic Ru Nanoparticles from Defective, Fluorite-Type Solid Solutions Sm2RuxCe2-x07 to Impart Stability on Dry Reforming Catalysts. ACS Catalysis 2020 10 (3), 1923-1937). (Year: 2020).
Nguyen et al. ("Ultrastable iridium-ceria nanopowders synthesized in one step by solution combustion for catalytic hydrogen production" J. Mater. Chem. A, 2014, 2, 19822). (Year: 2014).
Zhao et al "Layered-Double-Hydroxide Nanosheets as Efficient Visible-Light-Driven Photocatalysts for Dinitrogen Fixation", Sep. 28, 2017, Advanced Materials, vol. 29, article #1703828, p. 1-10. (Year: 2017).
Luo et al "Effect of La2O3 on Ru/CeO2—La2O3 Catalyst for Ammonia Synthesis", Oct. 14, 2009, Catalysis Letters, 133, 382-387. (Year: 2009).

* cited by examiner

164

166

170

172

206

238

METHODS OF HYDROGENATING CARBON DIOXIDE USING ELECTROCHEMICAL CELLS COMPRISING TUNABLE CATALYSTS

CROSS-REFERENCE TO RELATED APPLICATION

This application claims the benefit under 35 U.S.C. § 119(e) of U.S. Provisional Patent Application Ser. No. 62/706,510, filed Aug. 21, 2020, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05ID14517 awarded by the United States Department of Energy. The government has certain rights in the invention.

TECHNICAL FIELD

The disclosure relates generally to methods and systems of carbonaceous material production. More specifically, the disclosure relates to electrochemical cells including tunable catalysts, carbon dioxide hydrogenation systems including the tunable catalysts, and methods of utilizing the tunable catalysts for selective carbon dioxide hydrogenation.

BACKGROUND

As the global energy demand has increased, the combustion of fossil fuels has, as well. As a result, unprecedented amounts of carbon dioxide ($CO_2$) emissions have been released into the atmosphere, and the emissions rate continues to escalate. Concern regarding the potential negative consequences of these increasing emissions (e.g., climate change effects) has driven efforts to reduce atmospheric $CO_2$ levels through $CO_2$ capture, sequestration, and/or utilization.

In the utilization category, a promising approach for reducing $CO_2$ emissions involves chemical synthesis. Through chemical synthesis, $CO_2$ emissions may be converted into many desirable products, such as valuable carbonaceous materials and hydrocarbons (e.g., carbon monoxide and methane). However, unless these commodity chemicals are efficiently produced, $CO_2$ conversion is not profitable and, thus, not commercially feasible.

Some processes have focused on electrochemical $CO_2$ conversion because it is one of the more efficient pathways to produce multiple commodity chemicals from $CO_2$ emissions. One of these electrochemical conversion techniques is called hydrogenation (e.g., electrohydrogenation). By reacting $CO_2$ with hydrogen gas ($H_2$) in the presence of at least one catalyst, the $CO_2$ is hydrogenated, and chemicals such as carbon monoxide and methane may be produced. The carbon monoxide and methane may then be converted into additional commodity chemicals (e.g., formic acid, formaldehyde, methanol, other alcohols, formates, carboxylic acids, esters, methylated amines, formamides, aldehydes, etc.) through conventional reaction mechanisms.

However, such conventional electrochemical methods have not sufficiently addressed the needs of the industry because they are energy intensive (e.g., generating more $CO_2$ than is consumed to produce the desirable product) and/or prohibitively expensive (e.g., employing costly catalytic materials to effectuate desirable reaction kinetics).

Furthermore, the conventional electrochemical methods have not met the industry need of producing specific commodity chemicals and specific concentrations of commodity chemicals while reducing the amount of unwanted byproducts. For example, an industry may desire a single chemical from the conversion process or a mixture of chemicals with a specific ratio. To achieve this, the development of several compositions of catalysts and a complete redesign of electrolytic systems have been needed. However, this dramatically increases the cost of the electrolytic systems and decreases its efficiency.

BRIEF SUMMARY

A method of hydrogenating carbon dioxide is disclosed and comprises forming a tunable catalyst comprising at least one metal comprising a size within a range of from a single atom to about 999 nanometers and formulated to produce one or more carbon-containing compound. An electrochemical cell comprising a positive electrode, a negative electrode comprising the tunable catalyst, and an electrolyte between the positive electrode and the negative electrode is formed. Carbon dioxide is introduced to the negative electrode of the electrochemical cell and a potential difference is applied between the positive electrode and the negative electrode of the electrochemical cell to selectively hydrogenate the carbon dioxide. The hydrogen ions are diffused through the electrochemical cell. The carbon dioxide at the negative electrode is hydrogenated to selectively form carbon monoxide, methane, or a desired ratio of carbon monoxide and methane.

An electrochemical cell is also disclosed and comprises a positive electrode, a negative electrode, and an electrolyte between the positive electrode and the negative electrode. The negative electrode comprises a tunable catalyst formulated to selectively hydrogenate carbon dioxide. The tunable catalyst comprises at least one metal comprising a size within a range of from a single atom to about 999 nanometers and formulated to produce one or more specific carbonaceous product.

A carbon dioxide hydrogenation system is also disclosed and comprises a hydrogen source, a carbon dioxide source, and one or more electrochemical apparatus in fluid communication with the hydrogen source and the carbon dioxide source. The electrochemical apparatus comprises a housing structure configured and positioned to receive a hydrogen stream from the hydrogen source and a carbon dioxide stream from the carbon dioxide source. One or more electrochemical cells are within the housing structure. The electrochemical cell comprises a positive electrode and a negative electrode within the housing structure, and an electrolyte between the positive electrode and the negative electrode. The negative electrode comprises a tunable catalyst comprising a size within a range of from a single atom to about 999 nanometers. The tunable catalyst is formulated to selectively produce one or more carbon-containing compound.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

Figure 1:
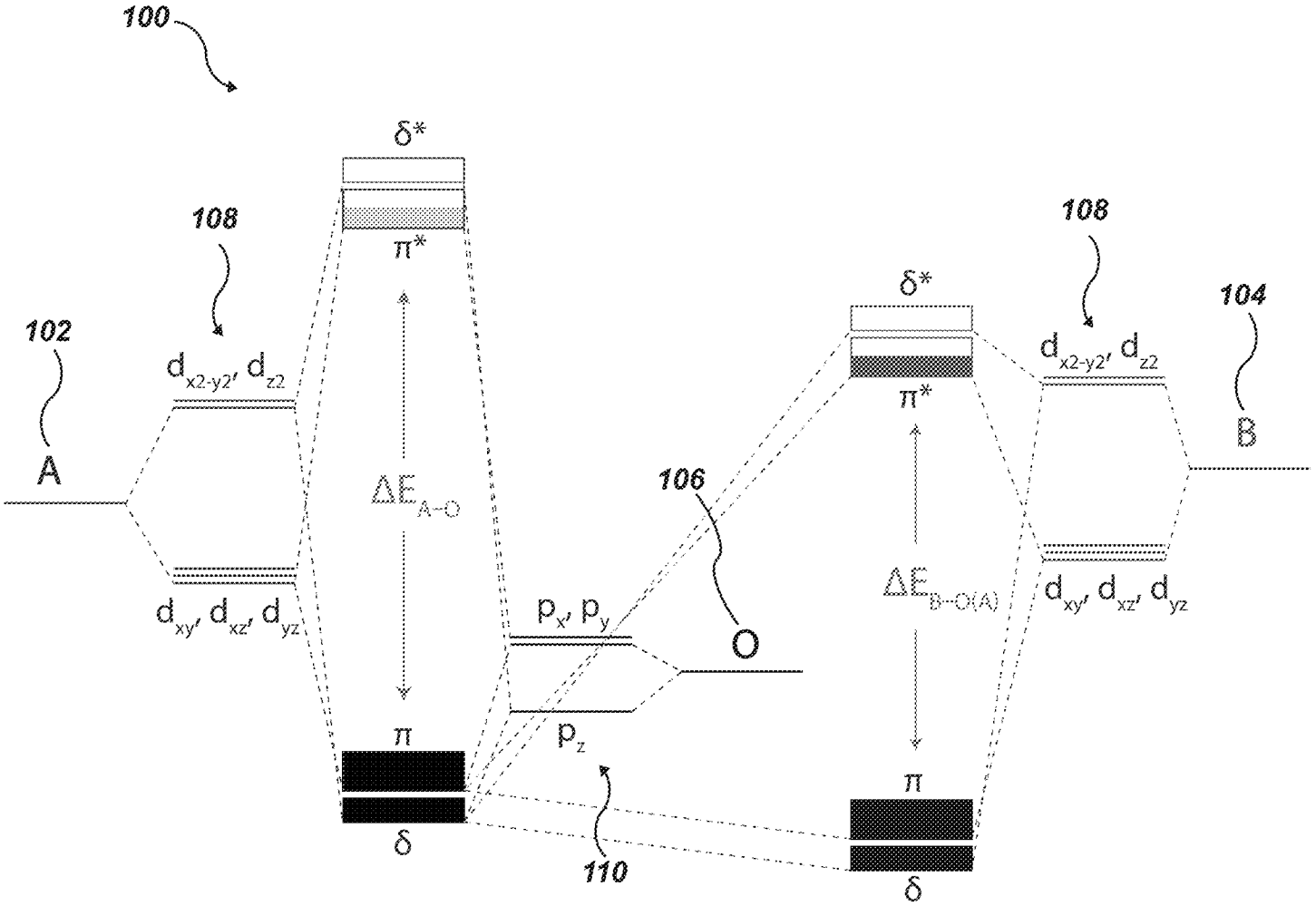
FIG. 1 is a schematic exemplifying the evolution of electronic structures through tuning the hybridization of a metal-oxygen compound in accordance with embodiments of the disclosure.

Carbon dioxide hydrogenation systems and electrochemical cells including tunable catalysts are disclosed, as are methods of using the tunable catalysts in the carbon dioxide hydrogenation systems and the electrochemical cells. The carbon dioxide hydrogenation system according to embodiments of the disclosure is used to selectively form one or more carbonaceous product from carbon dioxide by appropriate selection of the tunable catalyst. The carbonaceous product is selectively formed by tailoring electrocatalytic properties of the tunable catalyst. The tunable catalyst is a supported metal catalyst, such as a metal-metal oxide catalyst. By controlling bonding features between metal components and oxygen components of the tunable catalyst, the tunable catalyst is formulated and configured to selectively form a desired product or a combination of products at a desired ratio from the carbon dioxide. The bonding status between the metal components and the oxygen components may be altered to tailor the electrochemical behavior of the tunable catalyst. Electrocatalytic activity of the tunable catalyst is tailored to selectively produce one or more desired carbonaceous products from the carbon dioxide in the carbon dioxide hydrogenation system. The carbonaceous product or carbonaceous products may be used as a source to produce a commodity chemical. The carbon dioxide hydrogenation system according to embodiments of the disclosure is configured to electrohydrogenate the carbon dioxide at an intermediate temperature, such as at a temperature of from about 300° C. to about 500° C.

The tunable catalyst may include the metal-metal oxide catalyst that includes a metal support component and a metal oxide component. Hybridization between oxygen orbitals and metal orbitals of the tunable catalyst is controlled to produce a desired bonding status, which corresponds to the extent of bonding between metal-metal or metal-oxygen components of the tunable catalyst. The metal-oxygen hybridization within the tunable catalyst may be controlled to alter the tunable catalyst's surface chemical environment, enabling stabilization of specific transition states and control of species' movements to and from active sites during electrocatalysis. The interactions (e.g., bonding) between the metal and the oxygen components may be controlled to determine the metal-oxygen hybridization. As hybridization between the oxygen orbitals and the metal orbitals increases, one of the desired products may be selectively formed by the carbon dioxide hydrogenation process. Conversely, as hybridization between the oxygen orbitals and the metal orbitals decreases, a different desired product may be selectively formed by the carbon dioxide hydrogenation process. Alternatively, a combination of desired products may be formed by further adjusting the hybridization between the oxygen orbitals and metal orbitals. The combination of desired products may be formed at a desired ratio depending on an intended application (e.g., intended use) of the desired products, such as a source (e.g., feedstream) to produce a commodity chemical. A process window for selectively forming the desired product(s) may, therefore, be widened by altering the hybridization between the oxygen orbitals and the metal orbitals. Size (e.g., particle size) of the metal component also affects the hybridization between the oxygen orbitals and metal orbitals and may be controlled to tailor the electrocatalytic activity and selective formation of the carbonaceous product. The size of the metal may be controlled to tailor the selectivity of the carbon dioxide hydrogenation process.

Since the selectivity of the tunable catalyst is controllable by metal-oxygen hybridization or size of the metal, a single composition (e.g., a single chemical composition) of the tunable catalyst may be used in the carbon dioxide hydrogenation system and carbon dioxide hydrogenation process to achieve the desired selectivity of the carbonaceous product. Since a single carbonaceous product or a combination of carbonaceous products at a desired ratio may be formed using the carbon dioxide hydrogenation system according to embodiments of the disclosure, no separation acts are utilized to produce the desired product(s). The electrocatalytic activity of the tunable catalyst may be tailored to selectively produce, for example, carbon monoxide, methane, or a combination thereof from carbon dioxide in the carbon dioxide hydrogenation system. In contrast, conventional carbon dioxide hydrogenation systems and processes use multiple, different catalysts (catalysts of multiple chemical compositions) to produce different carbonaceous products and require separation processes to be conducted to produce the desired product. Alternatively, the conventional carbon dioxide hydrogenation systems must be redesigned to produce the desired carbonaceous products.

The following description provides specific details, such as material compositions and processing conditions (e.g., temperatures, pressures, flow rates, etc.) in order to provide a thorough description of embodiments of the disclosure. However, a person of ordinary skill in the art will understand that the embodiments of the disclosure may be practiced without necessarily employing these specific details. Indeed, the embodiments of the disclosure may be practiced in conjunction with conventional systems and methods employed in the industry. In addition, only those process components and acts necessary to understand the embodiments of the disclosure are described in detail below. A person of ordinary skill in the art will understand that some process components (e.g., pipelines, line filters, valves, temperature detectors, flow detectors, pressure detectors, and the like) are inherently disclosed herein and that adding various conventional process components and acts would be in accord with the disclosure. In addition, the drawings accompanying the disclosure are for illustrative purposes only, and are not meant to be actual views of any particular material, device, or system.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figure. Unless otherwise specified, the spatially relative terms are intended to encompass different orientations of the materials in addition to the orientation depicted in the figure. For example, if materials in the figure are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, "and/or" includes any and all combinations of one or more of the associated listed items.

As used herein, the term "carbonaceous product" means and includes a carbon-containing compound that includes one carbon (C1) atom.

As used herein, the term "configured" refers to a size, shape, material composition, material distribution, and arrangement of one or more of at least one apparatus facilitating operation of one or more of the structure and the apparatus in a pre-determined way.

As used herein, the terms "selectively form" or "selectively produce," or grammatical equivalents thereof, refer to forming one carbonaceous product preferentially to another carbonaceous product. The selectively formed carbonaceous product may be formed at greater than or equal to about 51%, while the other carbonaceous product is formed at less than or equal to about 49%. The selectively formed carbonaceous product may, for example, be formed at greater than or equal to about 60%, greater than or equal to about 70%, greater than or equal to about 80%, greater than or equal to about 90%, or greater than or equal to about 95%.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "substantially all" means and includes greater than about 95%, such as greater than about 99%.

As used herein, the terms "about" and "approximately" in reference to a numerical value for a particular parameter are inclusive of the numerical value and a degree of variance from the numerical value that one of ordinary skill in the art would understand is within acceptable tolerances for the particular parameter. For example, "about" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof.

As used herein, the term "may" with respect to a material, structure, feature or method act indicates that such is contemplated for use in implementation of embodiments of the disclosure and such term is used in preference to the more restrictive term "is" so as to avoid any implication that other, compatible materials, structures, features and methods usable in combination therewith should or must be excluded.

As used herein, the terms "catalyst material" and "catalyst" and their grammatical equivalents each mean and include a material formulated to promote one or more reactions, resulting in the formation of a product.

As used herein, the term "negative electrode" and grammatical equivalents means and includes an electrode having a relatively lower electrode potential in an electrochemical cell (e.g., lower than the electrode potential in a positive electrode therein).

Conversely, as used herein, the term "positive electrode" and grammatical equivalents means and includes an electrode having a relatively higher electrode potential in an electrochemical cell (e.g., higher than the electrode potential in a negative electrode therein).

As used herein, the term "electrolyte" and grammatical equivalents means and includes an ionic conductor, which can be in a solid state, a liquid state, or a gaseous state (e.g., plasma).

As used herein, the term "tunable catalyst" and grammatical equivalents means and includes catalysts that may be tailored by adjusting (e.g., increasing, decreasing) the extent of metal and oxygen hybridization and/or size of at least one of the catalyst materials to selectively produce a desired carbonaceous product(s).

The tunable catalyst may be a supported metal catalyst, such as the metal-metal oxide catalyst. The metal (e.g., the metal support) of the metal-metal oxide catalyst may be a transition metal, such as iron, cobalt, nickel, copper, ruthenium, rhodium, palladium, silver, iridium, platinum, or gold. The size (e.g., the particle size) of the metal may range from an atomic size to a nanoparticle size, such as from about 1 angstrom (Å) to about 999 nanometers (nm). The particle size distribution may include a mean particle size within a range of from about 1 Å to about 999 nm. By way of example only, the size of the metal may include a single atom (SA), nanoclusters (NC), or nanoparticles (NP). The nanoclusters include from 2 metal atoms to 100 metal atoms, such as from 5 metal atoms to 20 metal atoms, from 10 metal atoms to 40 metal atoms, from 20 metal atoms to 50 metal atoms, from 30 metal atoms to 60 metal atoms, from 40 metal atoms to 70 metal atoms, from 50 metal atoms to 80 metal atoms, from 60 metal atoms to 90 metal atoms, or from 70 metal atoms to 100 metal atoms, with a particle size range from about 0.1 nm to about 1 nm. The nanoparticles may exhibit a particle size from about 1 nm to about 999 nm, such as from about 1 nm to about 500 nm, from about 1 nm to about 100 nm, from about 1 nm to about 20 nm, from about 1 nm to about 10 nm, from about 1 nm to about 5 nm, from about 1 nm to about 4 nm, or from about 2 nm to about 5 nm. In some embodiments, the metal of the metal-metal oxide catalyst is iridium. While examples herein may describe using iridium as the metal of the tunable catalyst, other transition metals may be used.

The metal oxide of the metal-metal oxide catalyst may be an oxide of a lanthanide element, such as a doped oxide of the lanthanide element where a dopant of the doped metal may include a different lanthanide element. The metal oxide of the tunable catalyst may include, but is not limited to, a supported metal ceria based catalyst, such as a supported metal samarium doped ceria (SDC) catalyst. While examples herein may describe using SDC as the metal oxide of the tunable catalyst, other catalysts (e.g., other metal oxide catalysts) formulated to convert carbon dioxide to carbonaceous products, such as to carbon monoxide or to methane, may be used. The tunable catalyst may comprise a ceria- and iridium-based (e.g., SDC/Ir) catalyst.

The tunable catalyst may be formed with the metal oxide component as single atoms, as nanoclusters, or as nanoparticles. Particles of the metal oxide may be variable in size. In other words, the metal oxide may be formed at a variety of sizes. The tunable catalyst may be formed by conventional techniques or by a complexing agent tailoring method described in application Ser. No. 17/445,687 entitled "METHODS OF FORMING METAL NANOMATERIALS," the disclosure of which application is incorporated by reference herein in its entirety.

If, for example, the tunable catalyst includes increased hybridization between the oxygen orbitals and the metal orbitals, the tunable catalyst may function as a so-called "ionic metal" that exhibits favorable kinetics for the formation of CO in the carbon dioxide hydrogenation system. If, however, the tunable catalyst includes decreased hybridization between the oxygen orbitals and the metal orbitals, the tunable catalyst may function as a so-called "metallic metal" that exhibits favorable kinetics for the formation of $CH_4$ in the carbon dioxide hydrogenation system. Additionally, if, for example, the metal is dispersed in the tunable catalyst as nanoparticles, the metal may maintain metallic properties and selectively form $CH_4$. If, however, the metal is dispersed as single atoms, the metal may exhibit ionic properties and selectively form CO. The size of the metal (e.g., the particle size) may range from angstroms to microns, and more specifically, from single atoms to nanoparticle sizes.

The one or more product to be produced by the tunable catalyst may be a one carbon (C1) product, such as carbon monoxide (CO), methane ($CH_4$), methanol ($CH_3OH$), methylene ($CH_2$) or a combination thereof. In some embodiments, carbon monoxide is selectively formed using the tunable catalyst in the carbon dioxide hydrogenation system. In other embodiments, methane is selectively formed using the tunable catalyst in the carbon dioxide hydrogenation system. In yet other embodiments, a combination of carbon monoxide and methane at a desired ratio is formed using the tunable catalyst in the carbon dioxide hydrogenation system.

The tunable catalyst may, for example, be a $Sm_2O_3$-doped $CeO_2$ (SDC) supported Ir (SDC/Ir) catalyst that exhibits different iridium particle sizes. By way of example only, the iridium in the SDC/Ir catalyst may be a single atom, nanoclusters, or nanoparticles. Iridium-oxygen hybridization within the SDC/Ir catalyst is tailored by adjusting (e.g., increasing, decreasing) the particle size of the iridium of the SDC/Ir catalyst. The particle size (e.g., the Ir particle size) may range from angstroms to microns, and more specifically, from a single-atom (SA) size to a nanoparticle size. In accordance with embodiments of the disclosure, the Ir particles are of a particle size distribution in the range of from about 1 Å to about 1 μm. More specifically, the particle size distribution includes a mean particle size within a range of from about 1 Å to about 999 nm. The SDC/Ir catalyst may be used to selectively produce carbon-containing compounds, such as carbon monoxide (CO) or a hydrocarbon material (e.g., methane ($CH_4$)). The SDC/Ir catalyst may be formed by conventional techniques or by methods described in application Ser. No. 17/445,687 entitled "METHODS OF FORMING METAL NANOMATERIALS."

The iridium-oxygen hybridization within the tunable catalyst may be tuned to alter the catalyst's surface chemical environment, enabling the stabilization of specific transition states (*+CO, *COH, *HCO, where "*" represent an active site) and control of species' movements to and from active sites during electrocatalysis. As a result, the catalyst may be used in an electrochemical cell (e.g., a protonic ceramic $CO_2$ electrolyzer) that operates with a high selectivity, such as a selectivity of greater than about 90% (e.g., greater than about 95%) towards the desired product at an intermediate temperature (e.g., from about 300° C. to about 500° C.), at a low overpotential, and at ambient pressure. The tunable catalyst may also be used in systems performing $CO_2$ electrohydrogenation in tandem with light-alkane electrodehydrogenation and, consequently, the system may upgrade different carbon-containing compounds in a single act, significantly enhancing the efficiency, profitability, and commercial feasibility of $CO_2$ conversion systems. For example, $CO_2$ electrohydrogenation may be coupled with light-alkane electrodehydrogenation, such as ethane electrodehydrogenation.

The tunable catalysts, systems, and methods according to embodiments of the disclosure may reduce one or more of the time (e.g., processing acts), costs (e.g., material costs), and energy (e.g., thermal energy, electrical energy, etc.) used to produce the one or more carbonaceous products from $CO_2$ (e.g., carbon monoxide and/or methane) relative to conventional methods, catalysts, systems, and apparatuses of producing the carbonaceous products. Accordingly, the tunable catalysts, systems, and methods according to embodiments of the disclosure may be more efficient, durable, and reliable than conventional methods, conventional systems, and conventional apparatuses.

The tunable catalyst according to embodiments of the disclosure is advantageous over conventional catalysts because the tunable catalyst may greatly improve the production rate and energy efficiency of the electrochemical cell containing the tunable catalyst and/or the carbon dioxide hydrogenation system containing the tunable catalyst without sacrificing the carbon dioxide conversion rate. For example, the tunable catalyst of the disclosure may selectively produce the desired carbonaceous product or desired carbonaceous products at the desired ratio while reducing the amount of unwanted byproducts. The tunable catalyst according to embodiments of the disclosure may also be advantageous over conventional catalysts because the tunable catalyst may be operated at intermediate temperatures, such as from about 300° C. to about 500° C., and at ambient pressures. Therefore, the tunable catalyst may be utilized in on-site $CO_2$ conversion. Further, the tunable catalyst according to embodiments of the disclosure is cost-effective because the tunable catalyst may be tailored to selectively produce specific concentrations of the carbonaceous product(s) without redesigning the carbon dioxide hydrogenation system to produce these different concentrations. Additionally, the tunable catalyst according to embodiments of the disclosure is easily implemented and operated, since a single composition of the tunable catalyst may be tailored to selectively produce the desired carbonaceous product by altering the size of the metal within the tunable catalyst. As a result, no further separation process is utilized to produce the desired carbonaceous product. Since the electrocatalytic behavior of the tunable catalyst according to embodiments of the disclosure is tunable, the tunable catalyst may be used in various industries that utilize different carbonaceous products. The resulting carbonaceous product, such as CO, $CH_4$, or a combination thereof, may be used as a source to produce a commodity chemical. The commodity chemical may include, but is not limited to, formic acid, formaldehyde, methanol, a formate, a methylated amine, an alcohol other than methanol, a carboxylic acid, a formamide, an aldehyde, or other commercially valuable commodity chemical.

Embodiments of the disclosure will now be described with reference to FIG. 1, which schematically illustrates a molecular orbital diagram 100. In the molecular orbital diagram 100, the evolution of electronic structures through tuning the hybridization of a metal-oxygen compound is shown. Metal (A) 102 is bonded to oxygen (O) 106, and a second metal (B) 104 is introduced into the system. The molecular orbital diagram 100 shows that tuning the surface chemical environments of a catalyst significantly impacts its bonding features. For example, strong hybridization between O's 106 2p orbitals 110 and A's 102 *d* orbitals 108 takes place because of their spatial overlap and energetically similar electronic states, leading to σ-bonding states that largely assume O 106 features while σ*-antibonding states largely assume A 102 features. When the second metal B 104 having a different affinity is introduced into the A 102-O 106 system, the pristine band structure is reconstructed. Normally, the lower covalency of B 104-O 106 bonds can upgrade the covalency of neighboring A 102-O 106 bonds, which results in an increase in energy of the antibonding states, while decreasing the difficulty of the redox transition. In summary, introducing B 104 into the A 102-O 106 system has a direct effect on the electronic structures of the metal ions 102, 104 that are usually considered the functional components in catalysis. As a result, tunable catalysts of the disclosure include supported-metal catalysts that have tailorable electrocatalytic properties for the efficient production of desirable chemical compounds at controllable concentrations. More particularly, the tunable catalyst of the disclosure includes $Sm_2O_3$-doped-$CeO_2$ (SDC) supported Ir (SDC/Ir) catalysts produced in different particle size ranges, as the electrocatalytic behavior of SDC/Ir may be easily altered by altering the Ir particle size during material synthesis. Without being bound by any theory, it is believed that when nanoparticles of Ir are dispersed on an SDC support, Ir maintains its metallic properties, which is denoted herein as SDC/Ir—Ir. The SDC/Ir—Ir tunable catalyst may also be referred to herein as "metallic Ir." It is also believed that when Ir particle sizes decrease to single-atom sizes, the interaction between the SDC support and Ir changes dramatically and may result in the re-hybridization of Ir and O orbitals, which is denoted herein as SDC/Ir—O. The SDC/Ir—O tunable catalyst may also be referred to herein as "ionic Ir." The particle sizes (e.g., the Ir particle sizes) may range from angstroms to microns, and more specifically, from single-atom sizes to nanoparticle sizes. The Ir particles may be of a particle size distribution in the range of about 1 Å to about 1 micron. More specifically, the particle size distribution includes a mean particle size within a range of about 1 Å to about 999 nm. By adjusting the particle size of Ir within the SDC/Ir catalyst, a single $CO_2$ conversion product (e.g., CO or $CH_4$) may be produced. Alternatively, CO and $CH_4$ may be produced at a desired ratio.

Figure 2A:
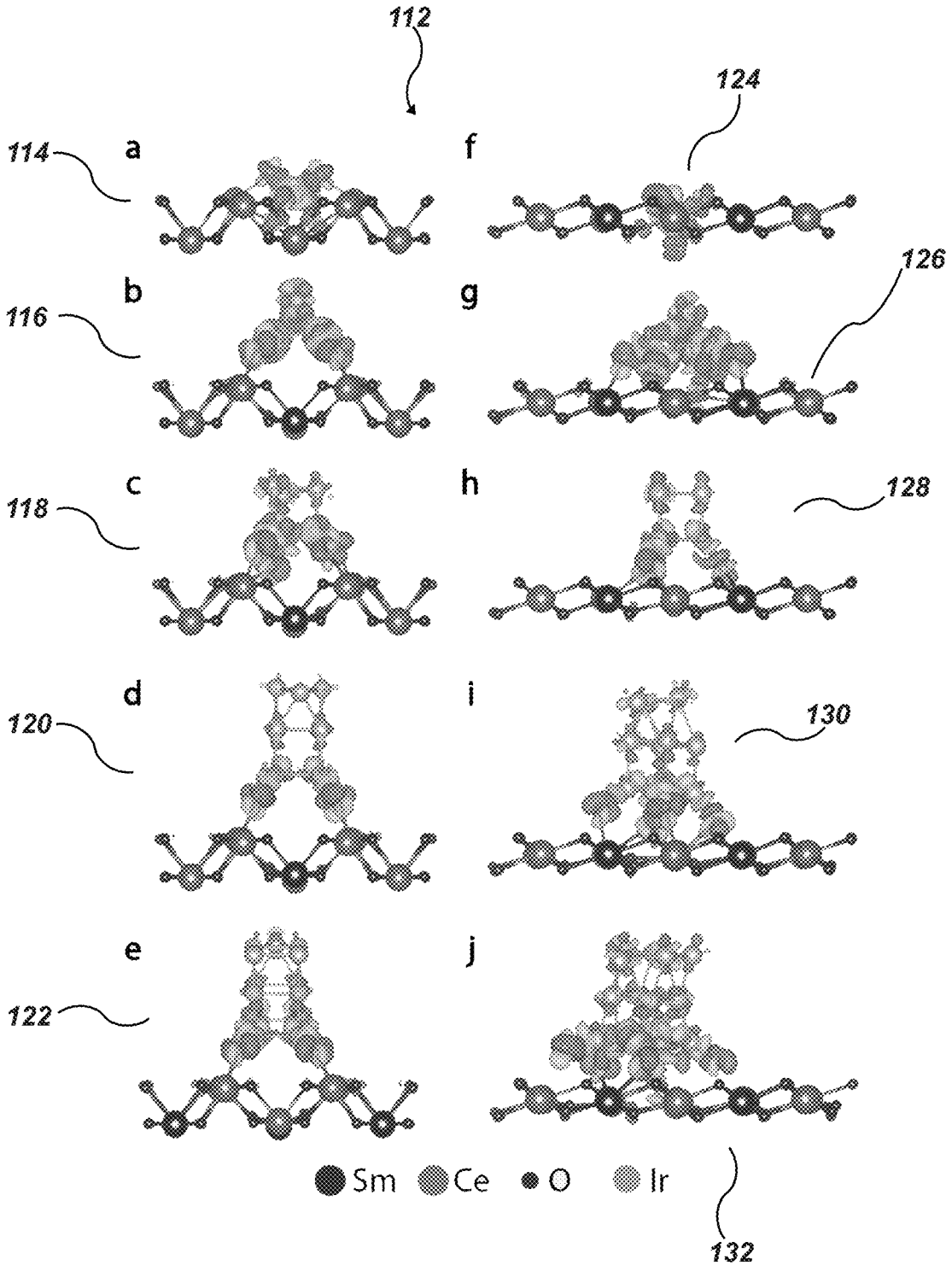
FIG. 2A is an illustration of an electronic interpretation of the interfaces of samarium-doped ceria (SDC) and iridium in accordance with embodiments of the disclosure.

Referring now to FIG. 2A, an electronic interpretation of what occurs at the interfaces of samarium-doped ceria (SDC) surfaces and iridium (IrN) clusters is shown. Density functional theory (DFT) calculations were used to investigate the interfaces. The SDC (110) and (111) terminated surfaces were chosen as the computational models, as they are stable and experimentally available. The SDC (110) and (111) terminated surfaces refer to the Miller indices of the crystallographic planes. Depending on the surface energy of SDC and the bond strength between Ir and O, the geometrical configuration of the SDC/Ir interface (as shown in 112) and interfacial charge transfer may change with the alteration of Ir size, which results in a transformation in the electronic structure and catalytic behavior of the material. The charge redistribution along the interface of SDC and IrN (where N is the number of Ir and may be equal to 1, 5, 6, 11, and 15) cluster was studied, and Bader analysis was employed to examine electron charges on each Ir atom. The simulated structures 112 indicated that the degree of partial wetting decreases as the Ir particle size (110)/IrN 114-122 (114, 116, 118, 120, 122) and (111)/IrN 124-132 (124, 126, 128, 130, 132) increases. Furthermore, a direct representation of electron accumulation (yellow) and depletion (cyan) on the Ir and O atoms upon introducing IrN onto an SDC surface is shown in 112, which schematically depicts the electron cloud distribution. The yellow and cyan isosurfaces exhibit the accumulation and depletion of electron densities at an isovalue of 0.006 e $Bohr^{-3}$. As the size of IrN particles increases on both (110) surfaces 114-122 and (111) surfaces 124-132, the total electrons transferring from IrN to SDC changes slightly, while the average electron loss on each Ir atom decreases remarkably. Without being bound by any theory, it is believed that the charge arrangement mainly results from the electron depletion of Ir atoms close to the SDC surface.

Figure 2B:
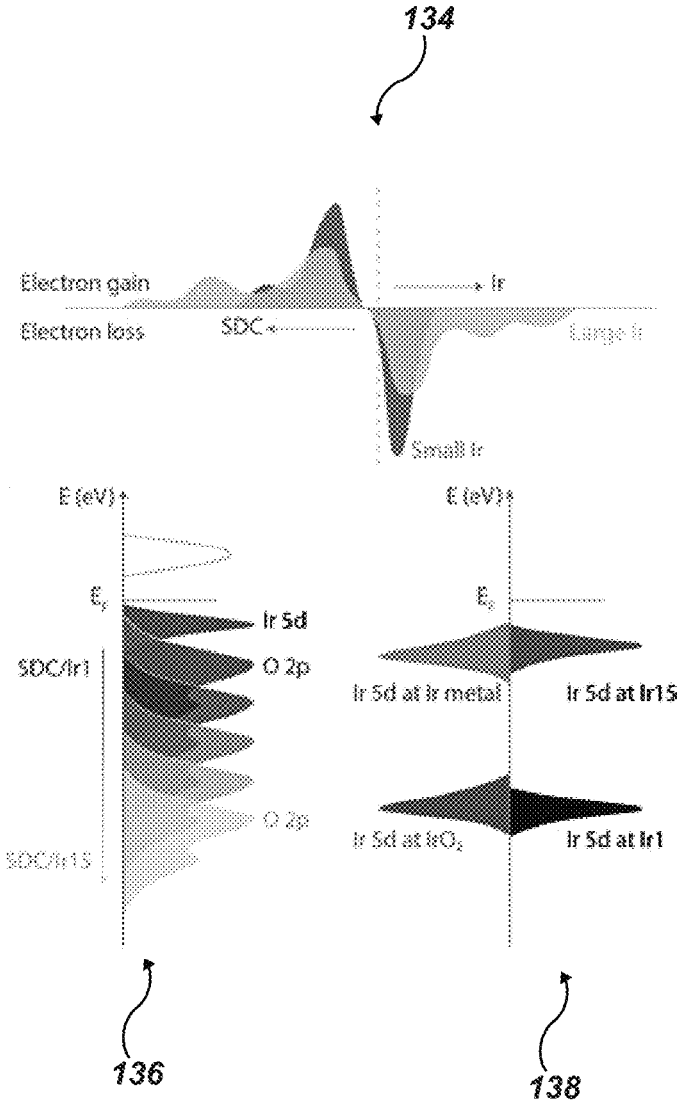
FIG. 2B illustrates the electronic properties at the SDC/IrN interface.

To further understand the electronic properties at the SDC/IrN interface, the plane-averaged charge density difference along the z-direction was analyzed. FIG. 2B shows an illustration of this electron redistribution at the SDC/IrN interface 134. Negative values correspond to the depletion, and positive values represent the accumulation of electrons. The electron redistribution indicates that the charge transferring from IrN to SDC is considerably dependent on the size and spatial location of the IrN cluster. As IrN size increases, the charge redistribution expands in the z-direction. Although interface depletions take place in all systems, they are not identical, which indicates that the re-hybridization of the Ir 5d and O 2p orbitals is both universal and diverse. Significantly, such re-hybridization is strongly associated with Ir size and is able to be predicted by DFT, indicating that supported metal catalysts may be further functionalized.

To gain a better understanding of this effect, projected density of states (PDOS) calculations 136, 138 were performed to detail the evolution of electronic orbitals. The PDOS calculations 136, 138 revealed that the p-d interaction between O 2p and Ir 5d orbitals pushes the band center of O 2p to lower energies as the number N increases, as shown in 136. This may lead to a significant impact on the charge transfer steps during catalysis, as the highest occupied molecular orbitals are usually dominated by the O 2p orbitals. In many cases, the catalytic activity may be dictated by the position of the O 2p band center relative to the Fermi level ($E_F$). A proportional relationship between the value of $E_{O2p}$-$E_F$ and the catalytic activity towards oxygen-containing species has been found, indicating that a low value of $E_{O2p}$-$E_F$ is beneficial for CO generation. As for Ir 5d orbitals, the PDOS of Ir atoms on Ir (111) and $IrO_2$ (100) surfaces were calculated for reference, as shown in 138. The band center energy of a single Ir atom on an SDC surface is quite close to that in an $IrO_2$ lattice, indicating ionic features in single-atom (SA) Ir. On the other hand, the band center of Ir15 increases and gets closer to that of metal Ir, indicating metallic features in larger Ir clusters. The PDOS calculations 136, 138 reveal that the electronic properties of Ir clusters evolve from ionic to metallic character with increasing atomic numbers, which may be exploited to tune the catalytic behavior of the materials.

Figure 3:
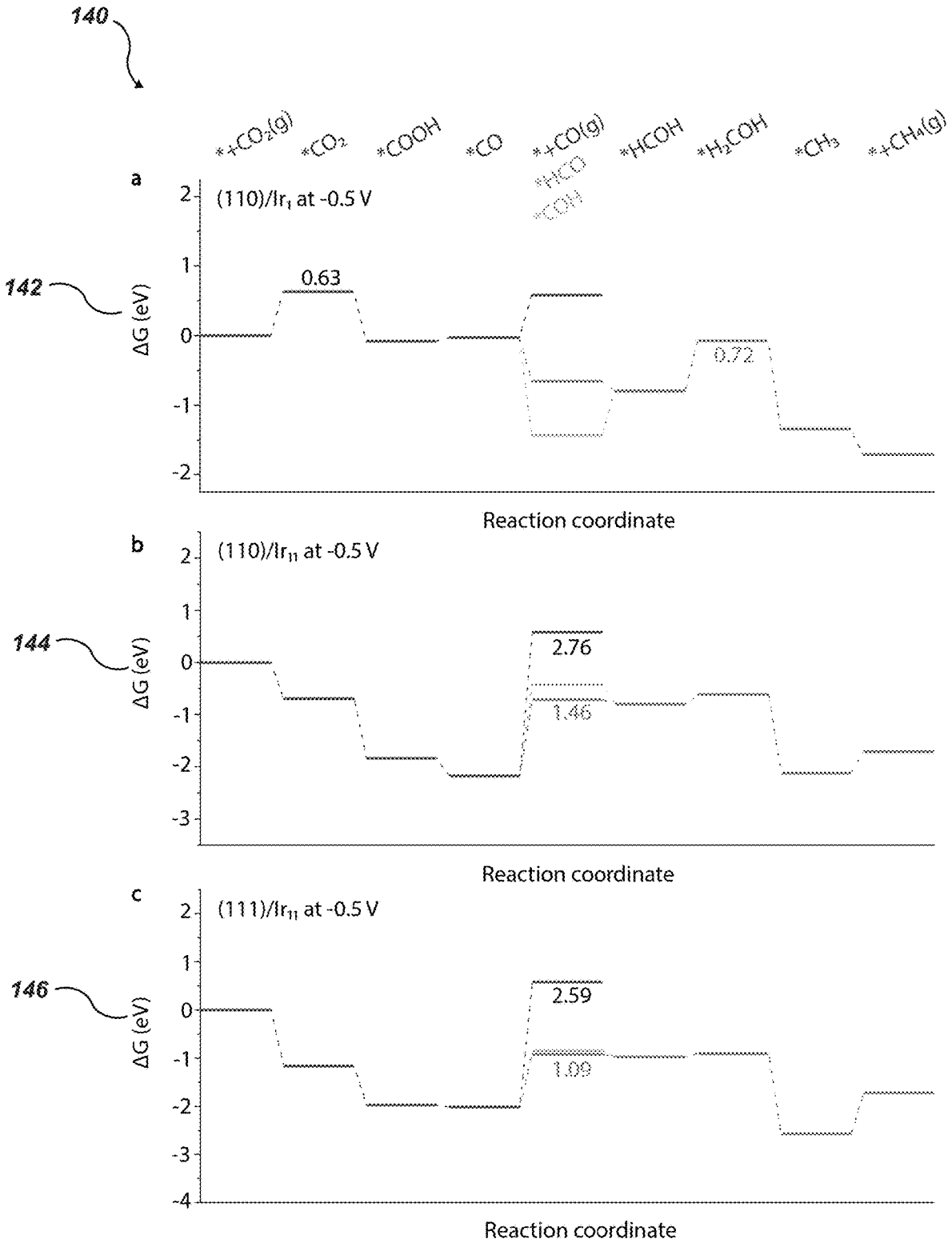
FIG. 3 is an illustration of density functional theory (DFT) calculations of $CO_2$ conversion reactions in accordance with embodiments of the disclosure.

Referring now to FIG. 3, an illustration of density functional theory (DFT) calculations of $CO_2$ conversion reactions in accordance with embodiments of the disclosure is shown. The Gibbs free energies of elementary $CO_2$ conversion reactions 140 on (110)/Ir1 surfaces 142, (110)/Ir11 catalysts 144, and (111)/Ir11 catalysts 146, are shown. The SDC (110) and (111) terminated surfaces were chosen as the computational models, as they are stable and experimentally available. The SDC (110) and (111) terminated surfaces refer to the Miller indices of the crystallographic planes. FIG. 3 shows how the charge redistribution of d orbital states may impact catalytic selectivity, and more specifically, the catalytic properties of SDC/IrN in the chemical conversion of $CO_2$ into CO or $CH_4$. *CO is a critical intermediate structure because the CO desorption energy is believed to determine the final product. The bond strength between CO and IrN increases with increasing atomic number, making the CO desorption energy surpass the energy requirement for hydrogenations and hydrodeoxygenation of *CO. Using (110)/Ir1 surface 142 as a non-limiting example, the CO desorption energy (0.71 eV) is lower than that for formaldehyde ($CH_2O$) hydrogenation (1.22 eV), which results in the formation of CO instead of $CH_4$ on small Ir clusters. On the other hand, higher energy is required for the *CO desorption process with increasing Ir cluster sizes. For example, when the catalyst is switched from (110)/Ir1 142 to (110)/Ir11 144, the CO desorption energy becomes higher than the free energies for CO hydrogenation and hydrodeoxygenation reactions, so $CH_4$ is the major product of the $CO_2$ hydrogenation reaction. A similar free energy profile is observed on the (111)/Ir11 catalyst 146 that also prefers producing $CH_4$ in the $CO_2$ hydrogenation reaction. Therefore, small size Ir (having more Ir—O bonding features) preferably forms CO, while large size Ir (having more Ir—Ir bonding features) preferably forms $CH_4$.

Figure 4:
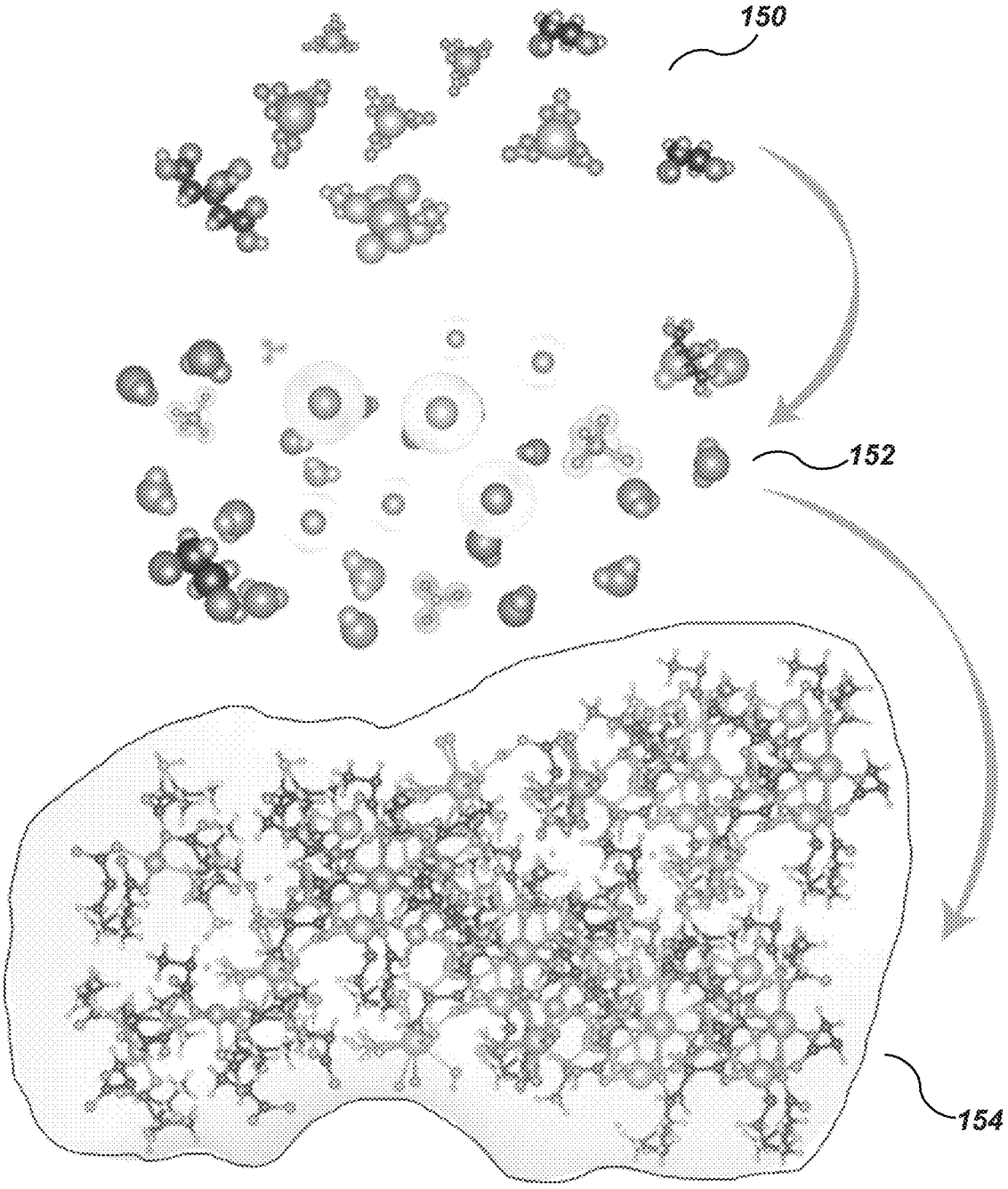
FIG. 4 is a schematic illustration of a method of producing tunable catalysts in accordance with embodiments of the disclosure.

In light of these findings, large cluster nanoparticulate Ir (NP Ir) and small cluster Ir (atomic Ir, which is a mixture of single-atom Ir and nanoclustered Ir) were introduced onto SDC surfaces to modulate the local configurations of Ir—Ir and Ir—O bonding features, respectively. Referring now to FIG. 4, a schematic illustrating a method of producing tunable catalysts in accordance with embodiments of the disclosure is shown. The tunable catalysts may be formed by a one-pot sol-gel procedure that enables precursors 150 (e.g., metal precursors and metal oxide precursors) to be hydrolyzed at a controlled rate, leading to atomic homogeneity. In accordance with this method, the precursors 150, which include metal salts of the metal and the metal oxide, and a suitable amount of a complexing agent (e.g., citric acid, ethylene glycol) may be dissolved in water to form a sol 152. These metal salts may be controllably hydrolyzed to obtain a desired homogeneous gel 154. This method may result in the spatial distribution of metal ions (e.g., transition metal ions, Ir ions) in a desired homogeneous manner.

Followed by calcination in air, Ir atoms may be incorporated into an SDC lattice at the atomic level, forming an ordered solid solution (SDCIr_SG), which was formed by a sol gel process. Upon reduction in $H_2$, Ir cations may be exsolved as nanoclusters (NCs) and as stabilized single-atoms (SAs) on an SDC surface to produce an SDCIr-O catalyst that largely features Ir—O bonding character with considerable Ir—O hybridization. Because the hydrolysis rate of $Ir^{4+}$ is much slower than those of $Sm^{3+}$ and $Ce^{3+}$, low concentrations of the complexing agent may be used to decrease the dispersity of Ir atoms, resulting in a disordered solid solution (SDCIr). This approach may be used to synthesize an SDCIr-Ir catalyst that largely features Ir—Ir bonding character with low-level Ir—O hybridization. These tunable catalysts were characterized to gain insight into their respective properties.

Figure 5:
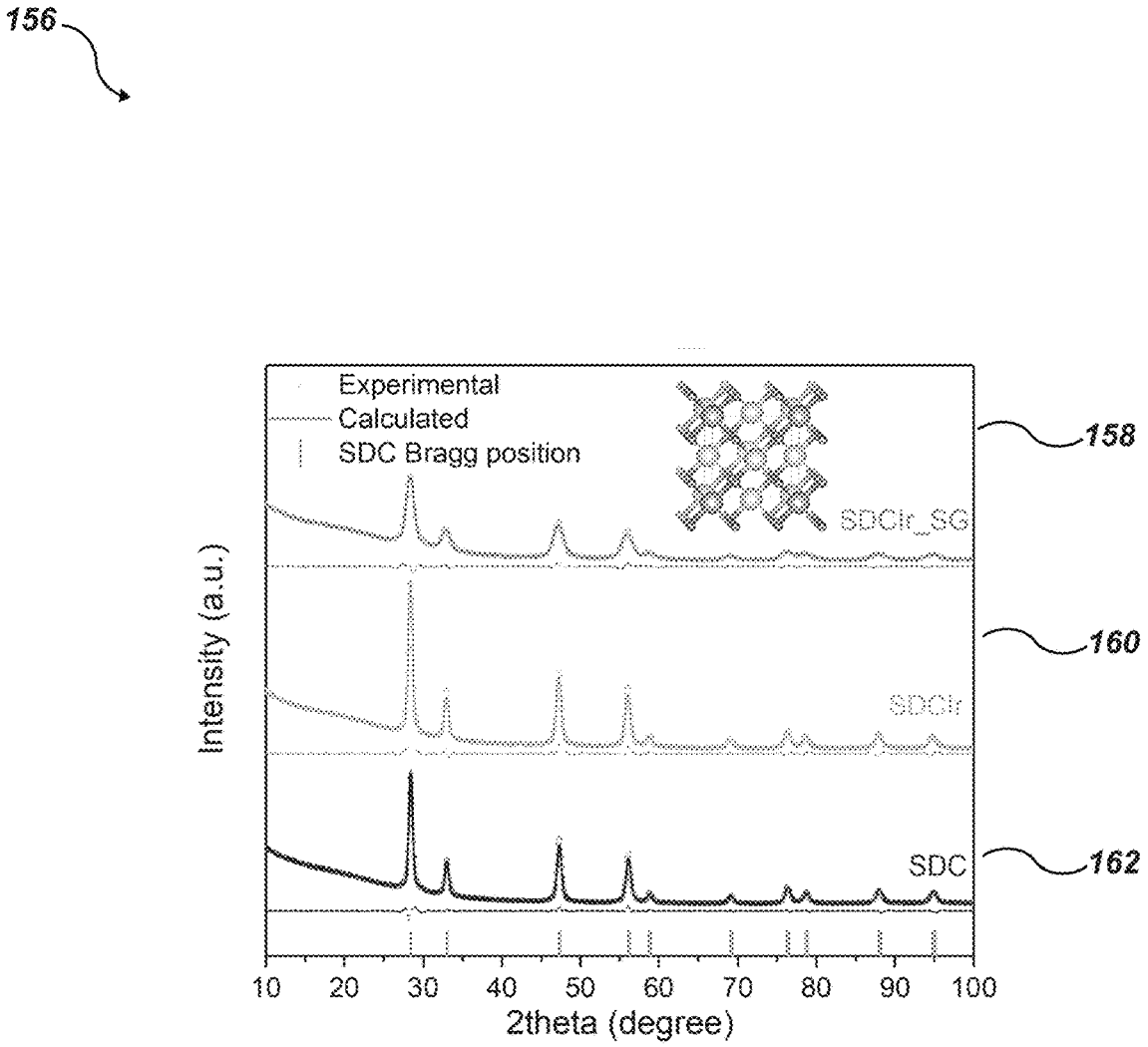
FIG. 5 is a graph of an X-ray diffraction (XRD) pattern of a tunable catalyst and its precursors formed in accordance with embodiments of the disclosure.

Referring now to FIG. 5, a graph of an X-ray diffraction (XRD) pattern of a tunable catalyst and its precursors formed in accordance with embodiments of the disclosure is shown. XRD patterns and Rietveld refinements 156 show that the diffraction peaks of SDCIr_SG 158 and SDCIr 160 are in good agreement with those of SDC 162. The XRD patterns and Rietveld refinements 156 also show that no peaks related to $IrO_2$ are present, which confirms that the Ir atoms are inserted into the SDC lattice after annealing in air. Upon reduction, SDC fluorite structures may be observed in both catalysts, but Ir atoms are extracted from the host lattice. Because of the exsolution of Ir, the diffraction peaks of SDCIr-Ir and SDCIr-O shift towards lower angles in comparison with those of SDCIr 160 and SDCIr_SG 158, indicating an increase in the lattice parameters of the compounds. Although the exsolved Ir species are not directly identifiable by XRD due to their low concentrations and extremely small sizes, the presence of Ir may be revealed by $H_2$ temperature-programmed reduction (TPR) profiles.

Figure 6A:
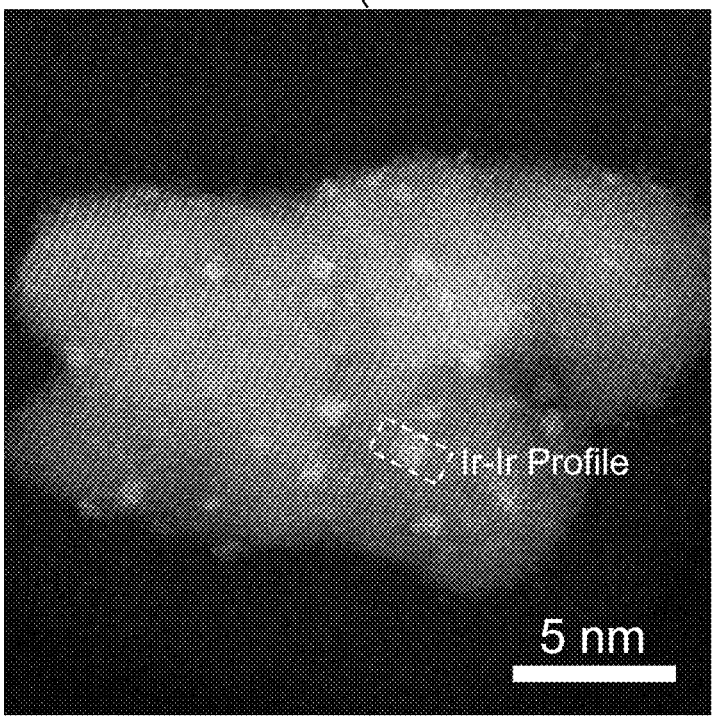
FIGS. 6A and 6B are micrographs and energy dispersive X-ray spectroscopic images of tunable catalysts formed in accordance with embodiments of the disclosure.
Figure 6B:
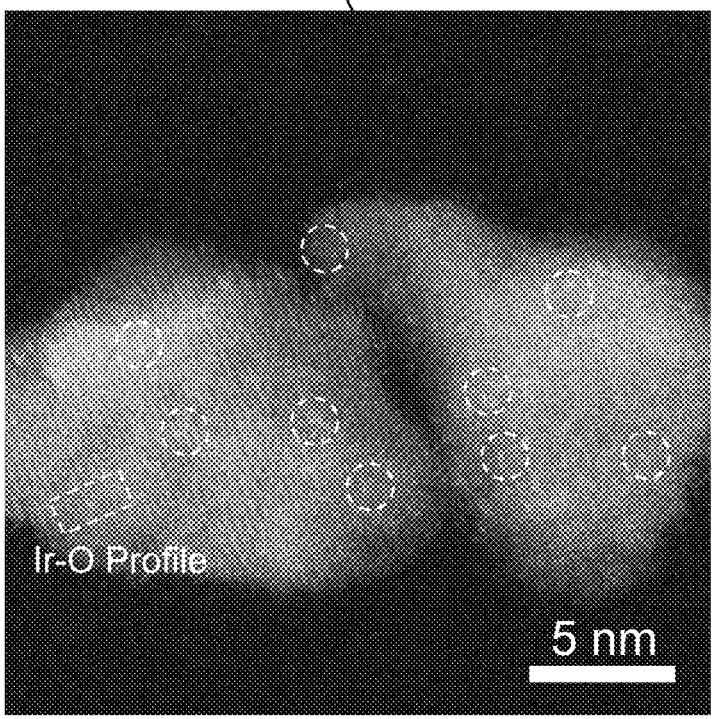
Figure 7A:
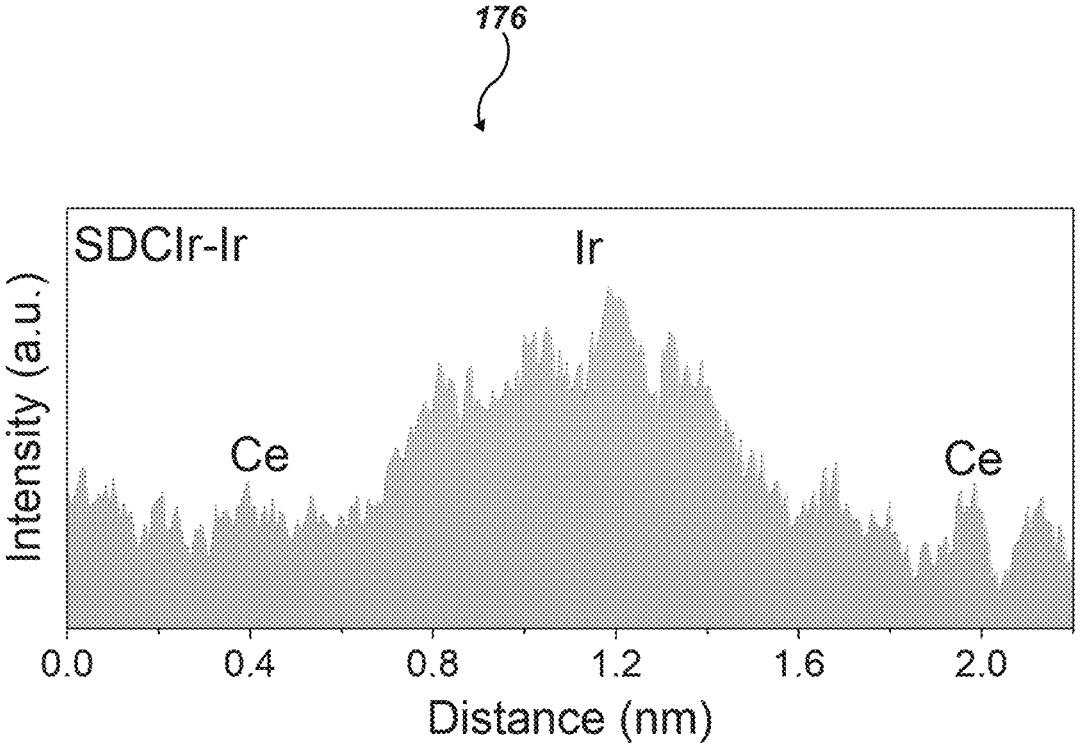
FIGS. 7A and 7B are graphs showing high-angle annular dark-field (HAADF) liner profiles of tunable catalysts formed in accordance with embodiments of the disclosure.
Figure 7B:
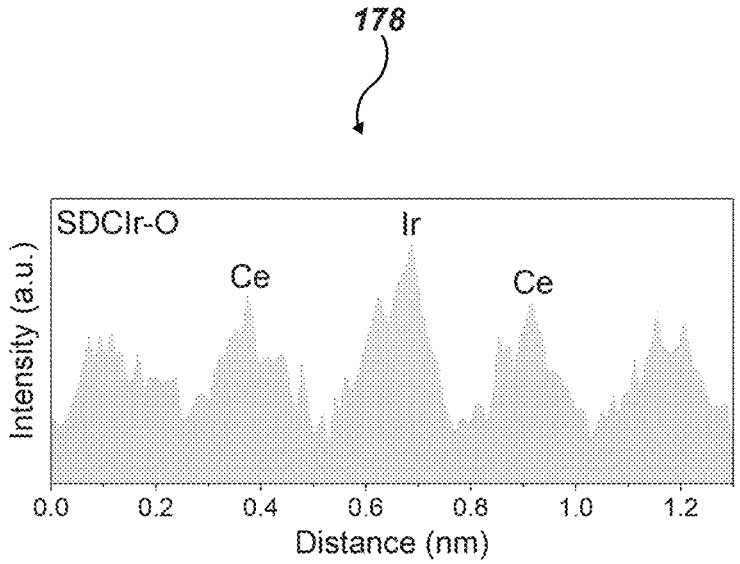

FIGS. 6A and 6B are micrographs and energy dispersive X-ray spectroscopic images of tunable catalysts formed in accordance with embodiments of the disclosure. The micrographs 166, 172 were taken using high-resolution scanning transmission electron microscopes (HRSTEM) to directly observe the features of SDCIr-Ir 164 and SDCIr-O 170 catalysts. The spatial positions and dimensions of Ir were determined by high-angle annular dark field (HAADF) imaging 166. As shown in FIG. 6A, Ir mainly existed as highly dispersed 1-2 nm-diameter nanoparticles (profile 176 in FIG. 7A) in an SDCIr-Ir catalyst. By contrast, HRSTEM-HAADF images 172 and profiles (profile 178 in FIG. 7B) of an SDCIr-O catalyst indicate that it comprises Ir single-atoms and a trace amount of Ir nanoclusters on SDC; no Ir nanoparticles were found at lower magnifications. Furthermore, elemental mappings do not show obvious spatial non-uniformities of the Ir distribution in the SDCIr-O catalyst. Without being bound by any theory, it is believed that the Ir species are mobile throughout the measurements, and do not remain in one place. This may explain why the Ir signal appears uniformly distributed in FIGS. 6A and 6B. These results further highlight the unique advantage of the complexing agent tuning method to synthesize Ir catalysts, and tailoring the selectivity of the SDC/Ir catalysts by altering the iridium particle size from atomic size to nanoparticle size.

Figure 8:
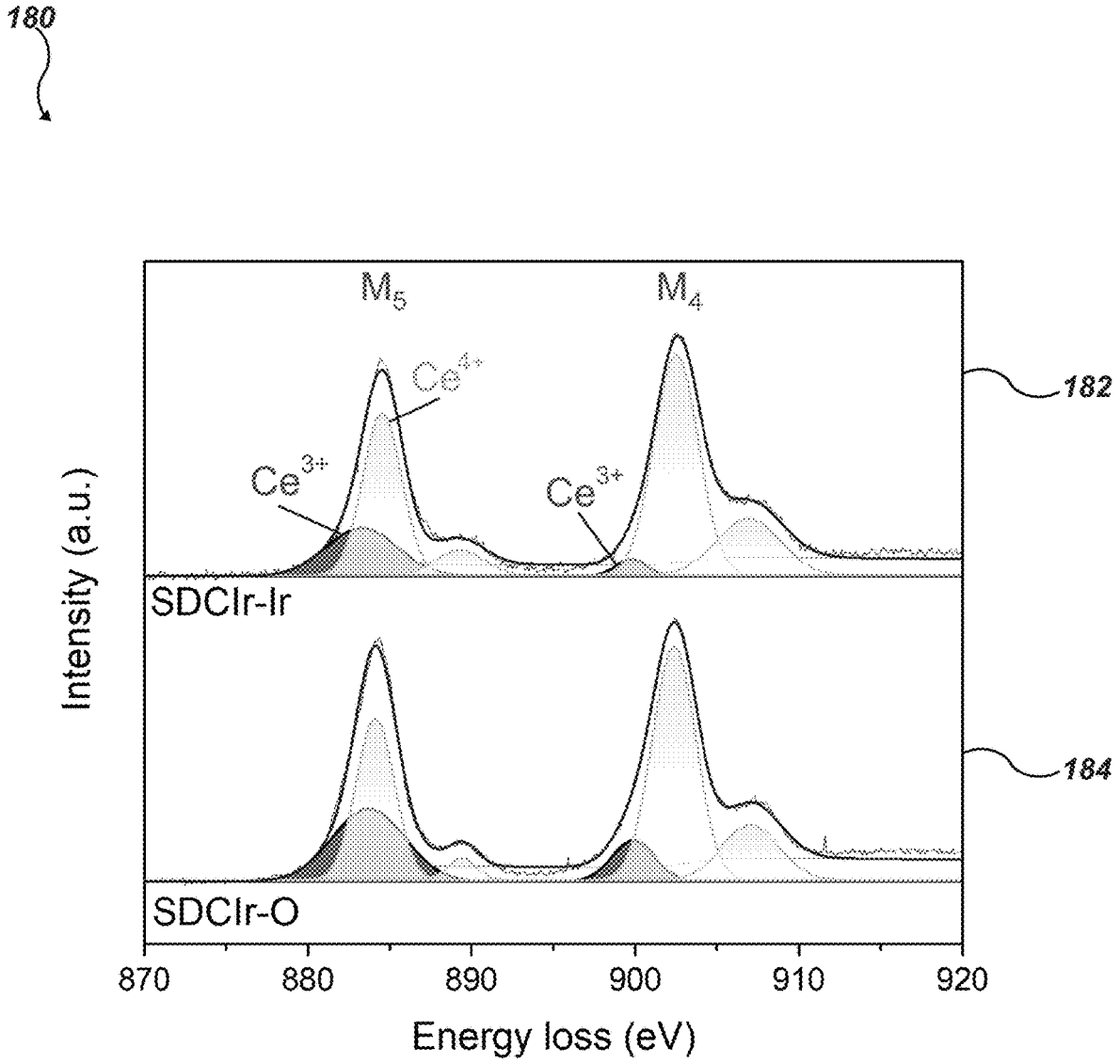
FIG. 8 is a graph of electron energy loss spectroscopy (EELS) spectra of tunable catalysts formed in accordance with embodiments of the disclosure.

FIG. 8 is a graph of electron energy loss spectroscopy (EELS) spectra of tunable catalysts formed in accordance with embodiments of the disclosure. The EELS spectra 180 shows profiles for both SDCIr-Ir catalysts 182 and SDCIr-O catalysts 184. As shown in the EELS spectra 180, the valence of Ce ($Ce^{3+}/Ce^{4+}$=0.3447) in SDCIr-O 182 shifts negatively with respect to that of SDCIr-Ir 184 ($Ce^{3+}/Ce^{4+}$ =0.18646). Without being bound by any theory, it is believed that the SDC support in the SDCIr-O catalyst will accommodate more electrons from Ir due to the stronger interfacial charge transfer effect. Therefore, more ionic Ir may be present in the SDCIr-O catalyst compared with the SDCIr-Ir catalyst.

Figure 9:
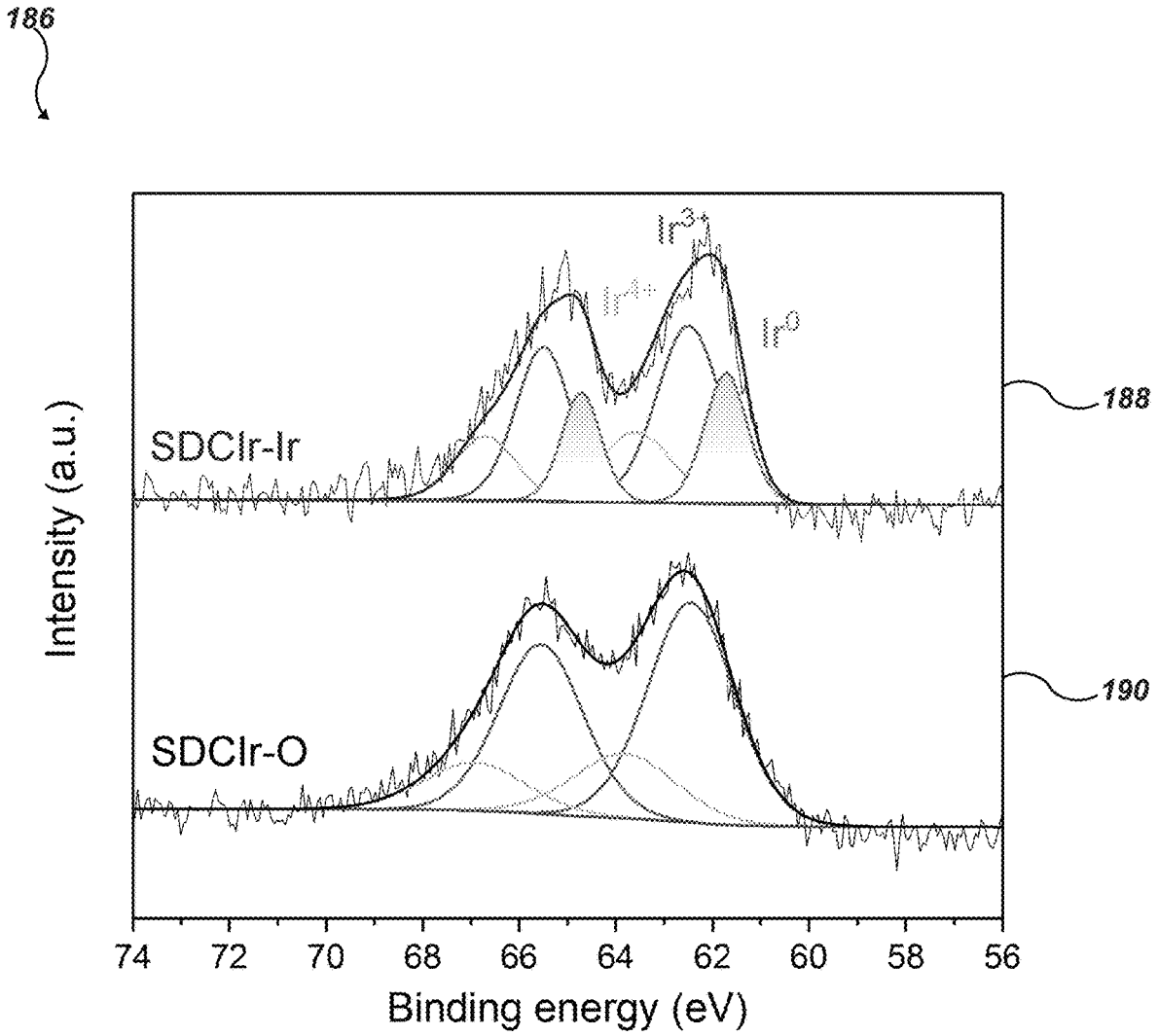
FIG. 9 is a graph of X-ray photoelectron spectroscopic (XPS) measurements of tunable catalysts formed in accordance with embodiments of the disclosure.

FIG. 9 is a graph of X-ray photoelectron spectroscopic (XPS) measurements of tunable catalysts formed in accordance with embodiments of the disclosure. The XPS profiles 186 show the existence of both ionic Ir and metallic Ir in SDCIr-Ir profile 188, but show that only ionic Ir is present in SDCIr-O profile 190. As previously discussed, Ir single-atoms and small Ir nanoclusters may have considerable interfacial charge transfer effects with the SDC support, forming ionic Ir species. In contrast, Ir nanoparticles may partially retain the metallic character that is enhanced as the particle size increases. The electron energy loss near edge structures shown in FIG. 8 also provides support for this conclusion.

Figure 10:
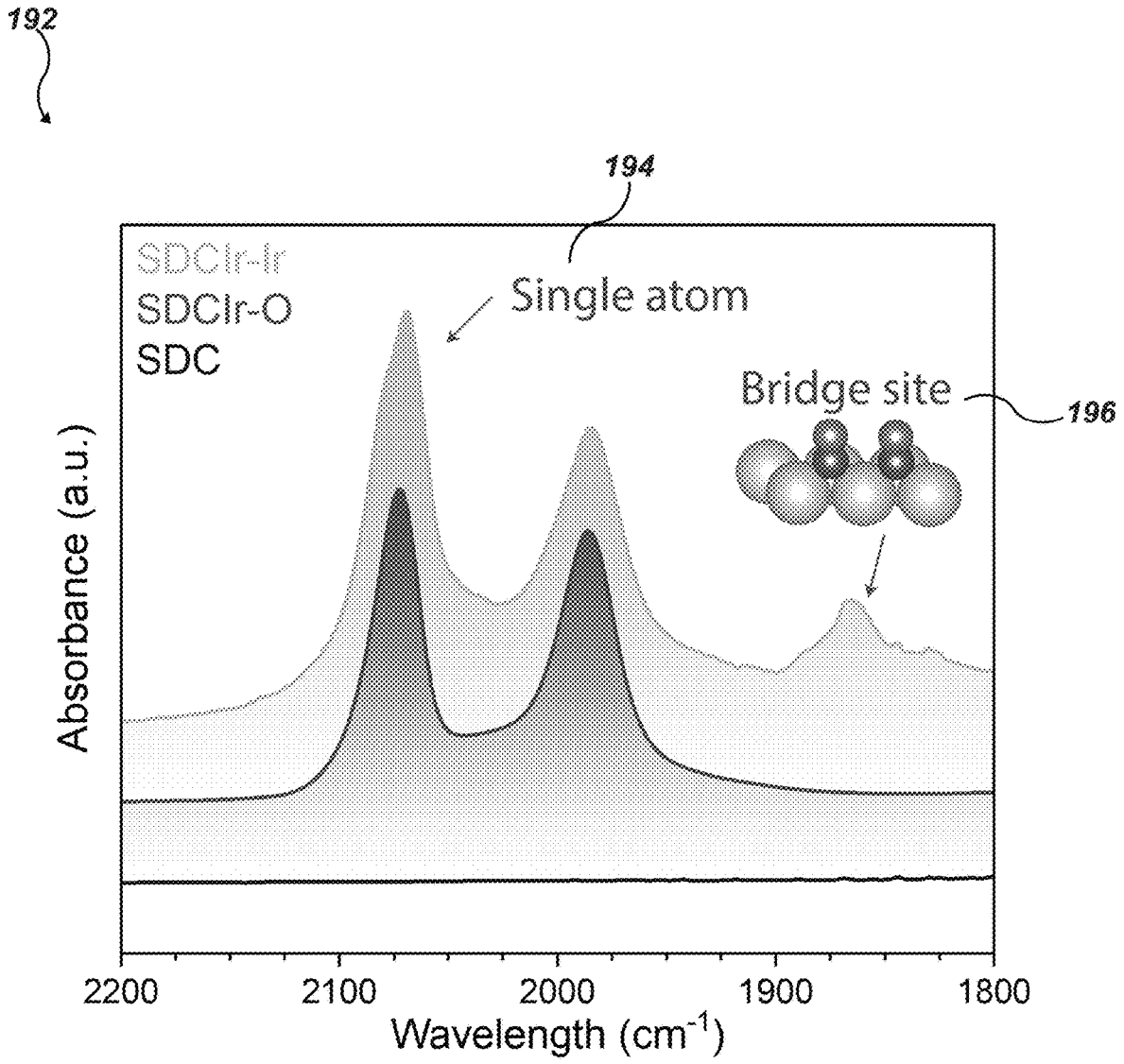
FIG. 10 is a graph of diffuse reflectance infrared Fourier transform spectroscopy (DRIFTS) spectra of tunable catalysts formed in accordance with embodiments of the disclosure.

The Ir atomic arrangement of the tunable catalysts of the disclosure was further investigated through in situ diffuse reflectance infrared Fourier transform spectroscopy (DRIFTS) using CO as a probe, as shown in FIG. 10. According to the plots 192, no Ir nanoparticles were detected in SDCIr-Ir, as there is a broad peak at about 1870 $cm^{-1}$ associated with the bridged CO adsorption 196 between neighboring Ir atoms. The Ir single-atom structures that yield characteristic peaks 194 (indicating linear adsorption of CO) between about 2070 $cm^{-1}$ and about 2080 $cm^{-1}$ are shown in plots 192. The peaks at about 1990 $cm^{-1}$ may be ruled out as the mixed peak of linear CO, bridged CO, and hollow CO.

The characterization results from the three complementary spectroscopic techniques discussed above strongly support the conclusion that tunable catalysts comprised of Ir—O and having considerable Ir—O hybridization is the major arrangement in SDCIr-O tunable catalysts, while tunable catalysts comprised of Ir—Ir and having minimal Ir—O hybridization is the major arrangement in SDCIr-Ir tunable catalysts. Thus, tunable catalysts with diverse metal-oxygen hybridization may be synthesized in accordance with embodiments of the disclosure.

Figure 11:
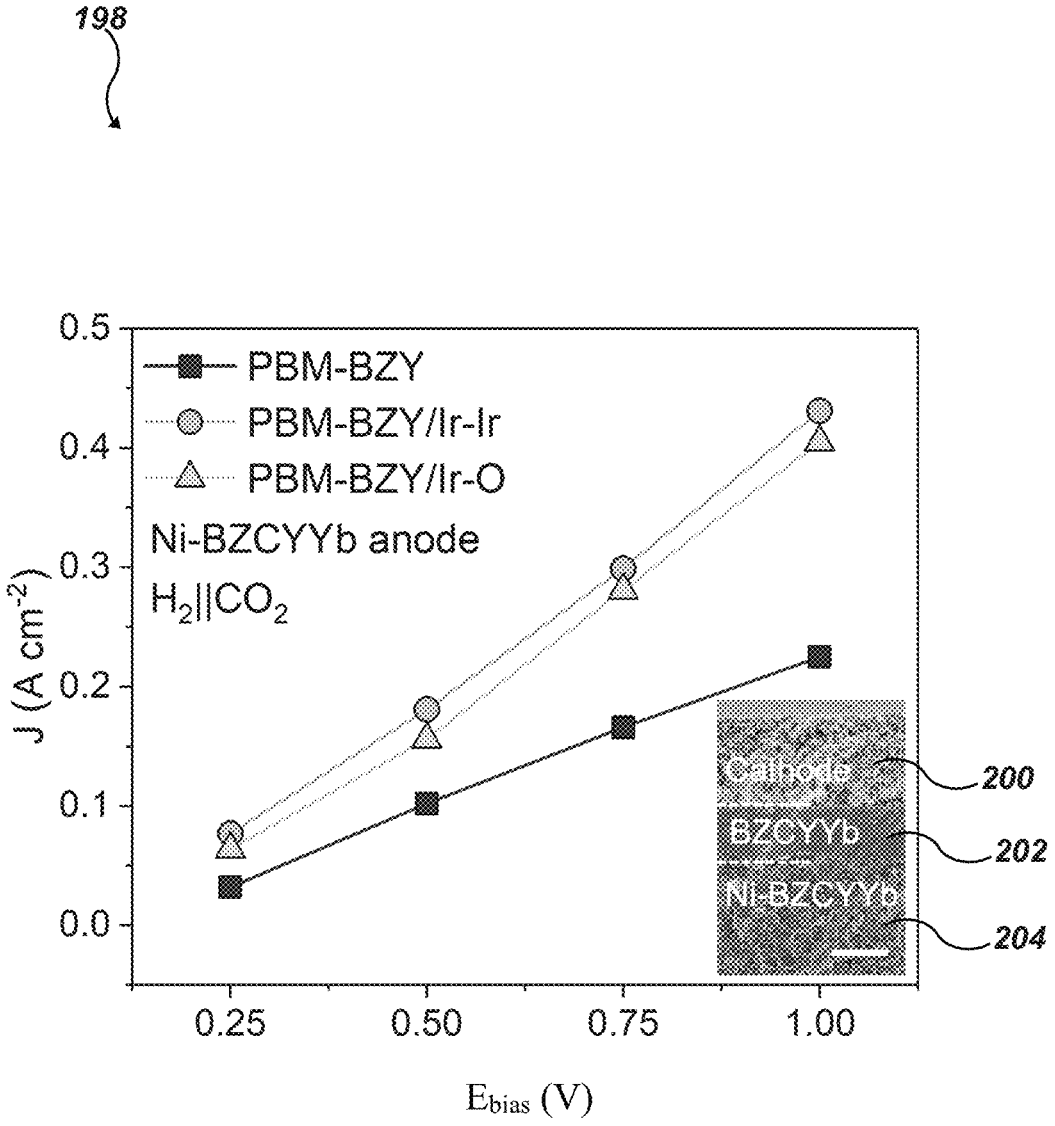
FIG. 11 is a graph of polarization curves of tunable catalysts formed in accordance with embodiments of the disclosure.

Using the tunable catalysts according to embodiments of the disclosure, an electrocatalytic study may characterize the activity and selectivity of the catalysts during $CO_2$ hydrogenation (e.g., electrohydrogenation), as shown in FIG. 11. To create electrochemical cells (e.g., electrolyzers) for the study, SDC/Ir catalysts were incorporated into anode-supported electrochemical cells. Micrographs of electrochemical cell components of the disclosure are shown in FIG. 11. The scale bar represents 20 μm. The cathode 200 is comprised of a $PrBaMn_2O_{5+\delta}$+$BaZr_{0.7}Y_{0.3}O_{3-\delta}$ (PBM-BZY) cathode. The electrolyte 202 is comprised of a BZCYYb electrolyte. The anode 204 is comprised of a Ni+$BaZr_{0.1}Ce_{0.7}Y_{0.1}Yb_{0.1}O_{3-\delta}$ (Ni—BZCYYb) anode. The SDC/Ir tunable catalysts may be introduced into the cathode by infiltration and annealing to ensure a high uniformity on the cathodic (e.g., PBM-BZY) scaffold. For convenience and clarity, the SDCIr-Ir infiltrated cathode may be referred to herein as "PBM-BZY/Ir—Ir," and the SDCIr-O infiltrated cathode may be referred to herein as "PBM-BZY/Ir—O." During the electrochemical measurements, the anode (e.g., Ni—BZCYYb) releases electrons from $H_2$ according to the following equation:

$$H_2 \xrightarrow{-2e^-} 2H^+.$$

Also during the electrochemical measurements, $CO_2$ is electrolyzed and hydrogenated in the cathode (e.g., PBM-BZY/X, where X represents the SDC/Ir tunable catalyst) according to the following equations:

$$CO_2 \xrightarrow{2e^-,\ 2H^+} CO + H_2O, \text{ or}$$

$$CO_2 \xrightarrow{8e^-,\ 8H^+} CH_4 + 2H_2O.$$

Because the electrochemical cells share identical components aside from the infiltrated SDC/Ir catalysts, the difference in catalytic performance may be attributed to the nature of the SDC/Ir catalysts. The catalytic behavior of SDCIr-O and SDCIr-Ir tunable catalysts may thus be compared utilizing these electrochemical cells.

Figure 12A:
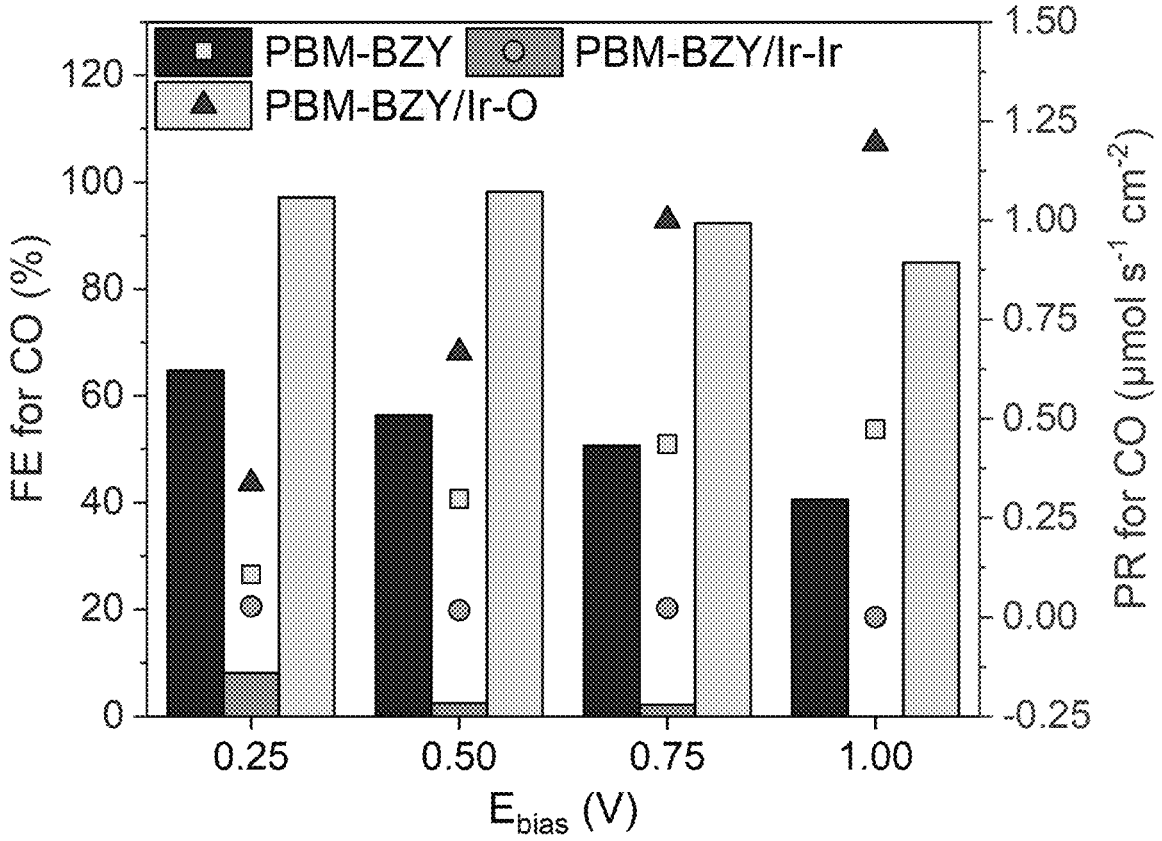
FIGS. 12A-12C are graphs of partial Faraday efficiencies and production rates of CO and $CH_4$ of tunable catalysts formed in accordance with embodiments of the disclosure.
Figure 12B:
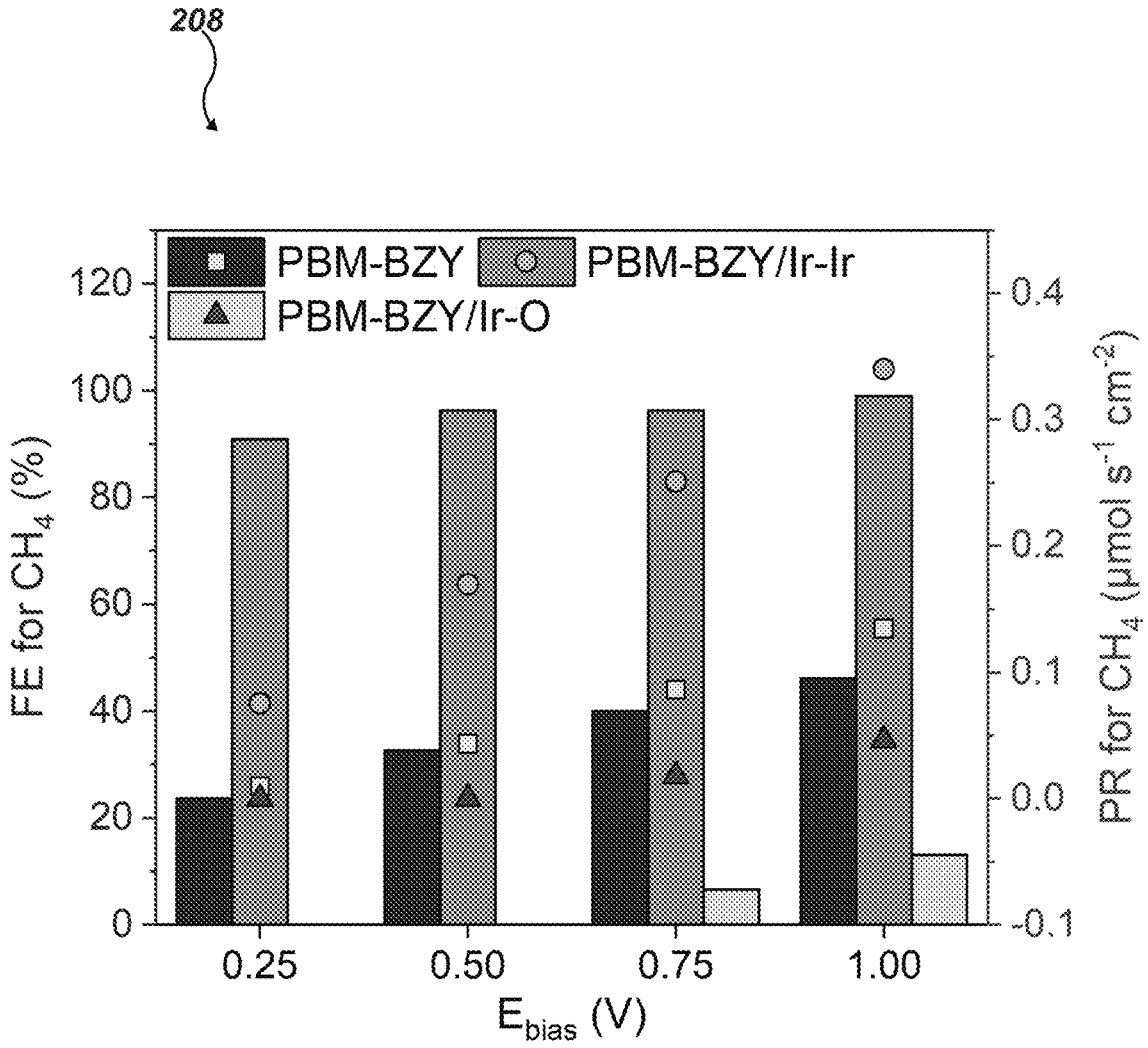

Still referring to FIG. 11, chronoamperometric measurements were taken to acquire polarization curves 198 of tunable catalysts of the disclosure. Flowing $H_2$ and about 5% $CO_2$ were fed to the anode and cathode of the electrochemical cell, respectively, having a flow rate of about 10 ml $min^{-1}$. Referring to FIGS. 11, 12A, and 12B together, a graph of bias potential-current density profiles 198 is shown, as is the selectivity towards CO profile 206 and $CH_4O$. 208 in three electrochemical cells at about 400° C. Compared with PBM-BZY, the electrochemical cells including SDC/Ir catalysts may respond more aggressively towards the decomposition of hydrogen. Additionally, unmodified PBM-BZY may have a current density limited to less than about 230 mA $cm^{-2}$. PBM-BZY/Ir—Ir and PBM-BZY/Ir—O, by contrast, may deliver considerably larger current densities, which may peak at more than about 400 mA $cm^{-2}$ at an equal bias potential 198. They may also have very low (e.g., less than about 2%) partial Faraday efficiency (FE) for hydrogen production. Despite the considerable difference in the metal-oxygen hybridization, both SDCIr-Ir and SDCIr-O catalysts may greatly enhance the partial FE for $CO_2$ hydrogenation, exhibiting great promise for facilitating $CO_2$ conversion while suppressing hydrogen evolution reactions (HER), improving the efficiency of $CO_2$ hydrogenation.

Figure 12C:
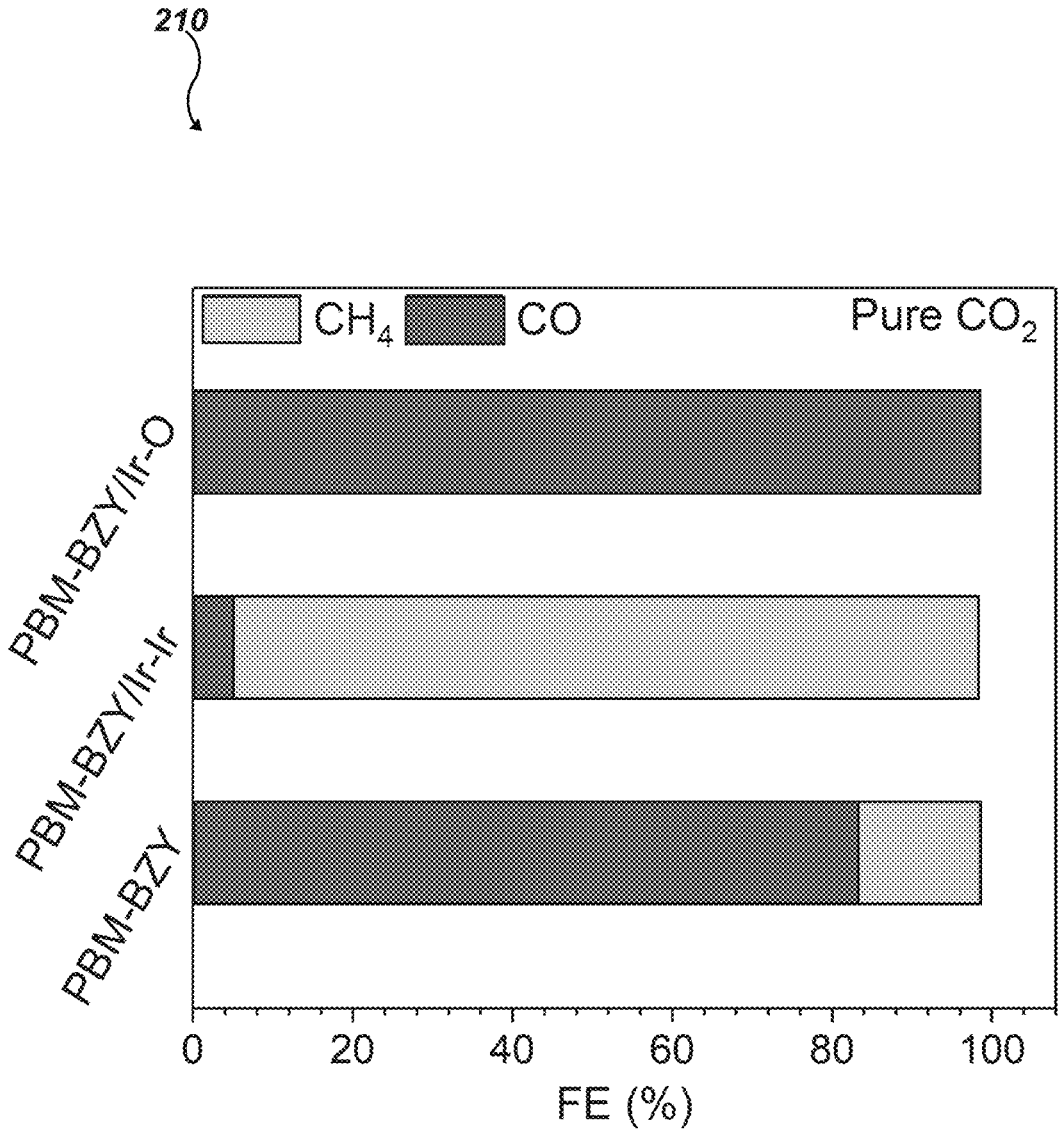

To assess whether tuning of the metal-oxygen hybridization may help produce hydrocarbons as predicted from the DFT calculations previously discussed, the $CO_2$ reduction of different hydrocarbon products were analyzed via gas chromatography-mass spectrometry, as shown in FIGS. 12A-12C. With respect to the PBM-BZY catalyst profile, a $CO_2$-to-CO partial FE of 56.32% (as shown in CO profile 206) and a $CO_2$-to-$CH_4$ partial FE of 36.28% (as shown in $CH_4$ profile 208) may be observed at 400° C. with an $E_{bias}$ of 0.5 V. The CO profile 206 and the $CH_4$ profile 208 indicate that increasing temperature enhances CO production, and enlarging bias potential enhances $CH_4$ production, which is reasonable from a thermodynamic and chemical equilibrium standpoint. With respect to PBM-BZY/Ir—Ir tunable catalysts of the disclosure, they may exhibit notable $CO_2$-to-$CH_4$ partial FE (96.28% at 0.5 V) and $CO_2$-to-$CH_4$ partial current density (130.94 mA $cm^{-2}$ at 0.5 V), as well as a very weak activity towards CO (partial FE for CO formation is less than 2.5% at 0.5 V), as shown in $CH_4$ profile 208. Conversely, the opposite may be seen in PBM-BZY/Ir—O tunable catalysts of the disclosure, where considerable $CO_2$-to-CO conversion may be attained, as shown in CO profile 206. For example, at 400° C. with an $E_{bias}$ of 0.5 V, the $CO_2$-to-CO partial FEs for PBM-BZY/Ir—O are 98.21% in 5% $CO_2$, as shown in CO profile 206. Such a high selectivity towards CO (FE=98.76%) may also be observed in pure $CO_2$, which is shown in profile 210 of FIG. 12C. Thus, over a broad range of operation conditions (e.g., temperature, bias potential, and concentration of feed gas), the SDCIr-Ir and SDCIr-O tunable catalysts of the disclosure may be utilized in electrochemical cells (e.g., protonic ceramic electrolyzers), and may simultaneously retain their high selectivity towards certain commodity chemicals (e.g., $CH_4$ and CO), displaying the promising universal applicability of the tunable catalyst design.

Figure 13A:
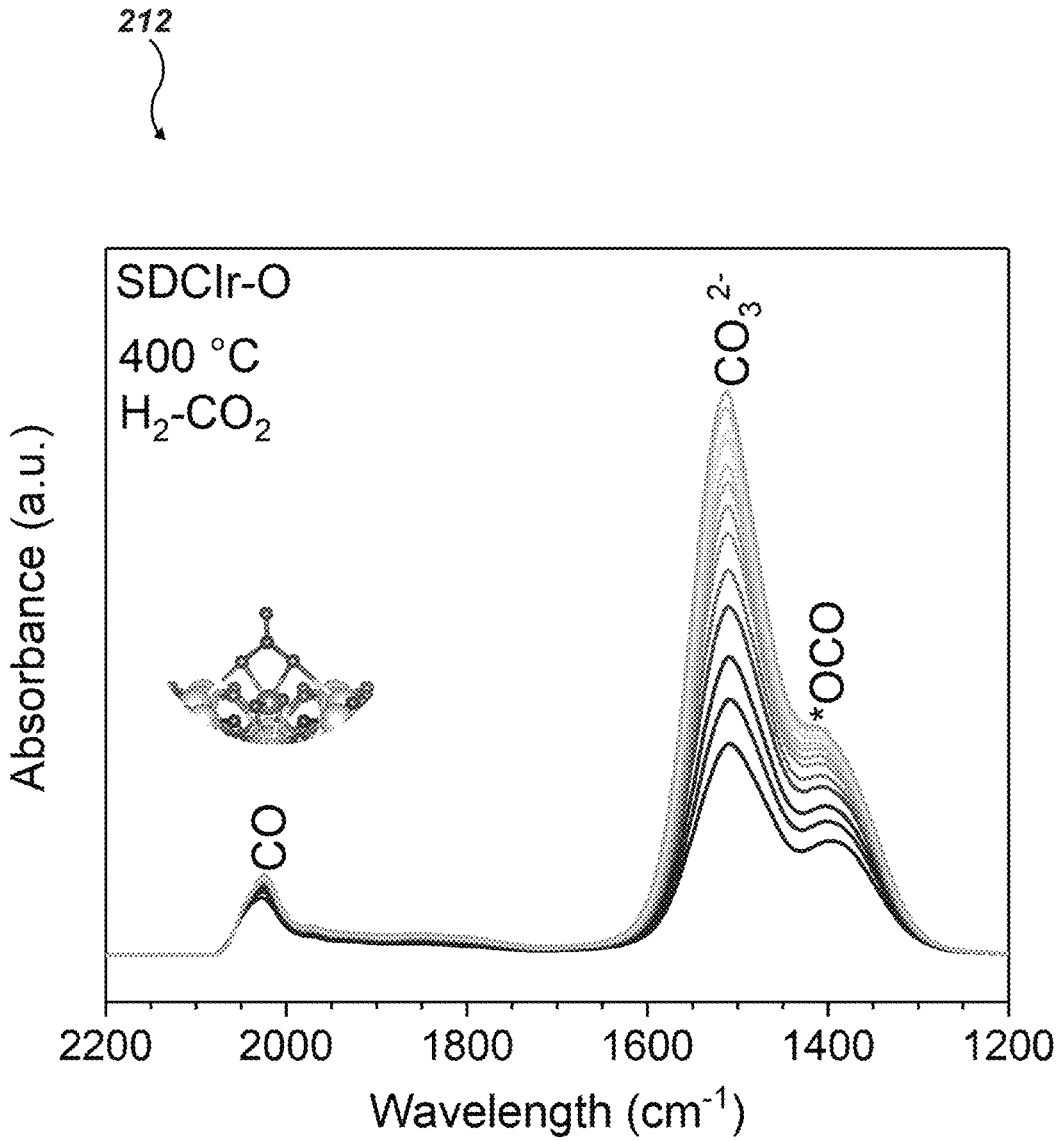
FIGS. 13A and 13B are graphs of DRIFTS spectra of tunable catalysts formed in accordance with embodiments of the disclosure.
Figure 13B:
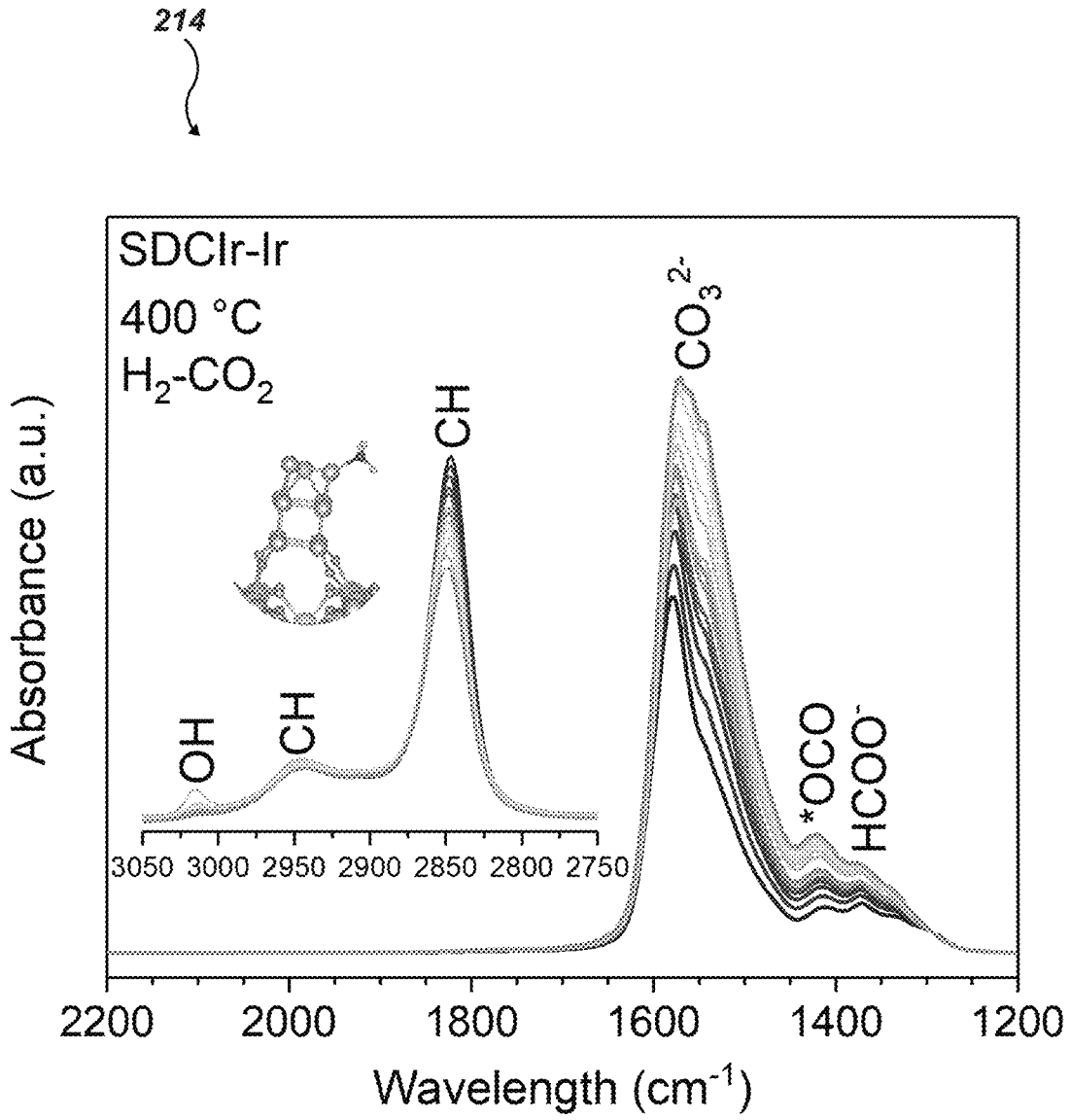

To understand how SDC/Ir catalysts may impact the selectivity, operando DRIFTS measurements were performed as shown in FIGS. 13A and 13B, having reaction conditions of $CO_2$—$H_2$ at about 400° C. and under about 1 bar. These measurements reveal the mechanism underlining the interplay between surface chemical environments and proton-coupled electron transfer. DRIFTS spectra 212, 214 of SDCIr-O 212 and SDCIr-Ir 214 reveal several adsorbed surface intermediates. For example, $CO_3^{2-}$ is observed at about 1500-1600 $cm^{-1}$; $HCOO^-$ is observed at about 1365 $cm^{-1}$; *OCO is observed at about 1400-1450 $cm^{-1}$; *CO is observed at about 2000-2100 $cm^{-1}$; and *CH groups are observed at about 2850 $cm^{-1}$ and about 2950 $cm^{-1}$. Different distributions of adsorbed intermediate species may be present on the surface of SDCIr-Ir and SDCIr-O tunable catalysts, supporting the electrochemical results above, which indicated that the different bonding character between Ir and O may have different functionalities in the chemical conversion of $CO_2$. The strong peaks (those between about 2000 $cm^{-1}$ and about 2100 $cm^{-1}$) relate to CO species found on the surface of the SDCIr-O catalyst 212, while no significant peaks representing CO species were found in SDCIr-Ir catalyst 214, indicating that SDCIr-O is more conducive to selective reduction of $CO_2$ into CO. However, the formation of $HCOO^-$ intermediates, which is often associated with the formation of hydrocarbons, is revealed by peaks at about 1365 $cm^{-1}$. As such, the operando DRIFTS spectrum of SDCIr-Ir 214 may be extended to higher wavelength ranges to further highlight the formation of $CH_4$-related species on the surface of SDCIr-Ir. Notably, absorbance peaks at about 2850 $cm^{-1}$ and about 2950 $cm^{-1}$ confirm the existence of C—H bonds in the SDCIr-Ir spectra 214, which may be due to the assistance of abundant Ir—Ir bonds. Thus, selective catalysis through tuning the metal-oxygen hybridization of the tunable catalysts is directly observed, and the stabilization of specific transition states and control of the transportation of species to and from active sites may be used to tune the catalysts to selectively produce desired $CO_2$ conversion products.

Figure 14A:
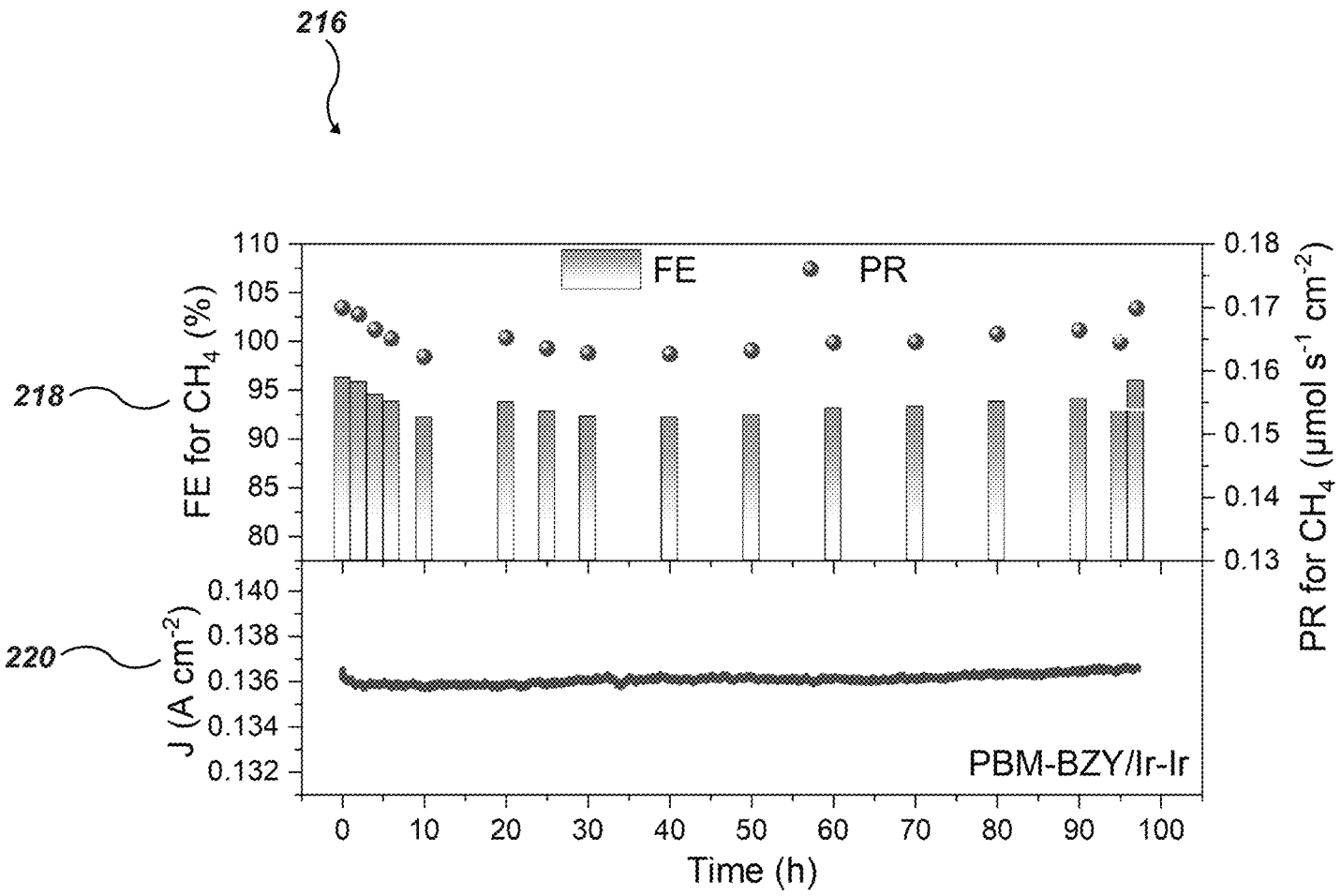
FIGS. 14A and 14B are long-term stability tests of tunable catalysts formed in accordance with embodiments of the disclosure.
Figure 14B:
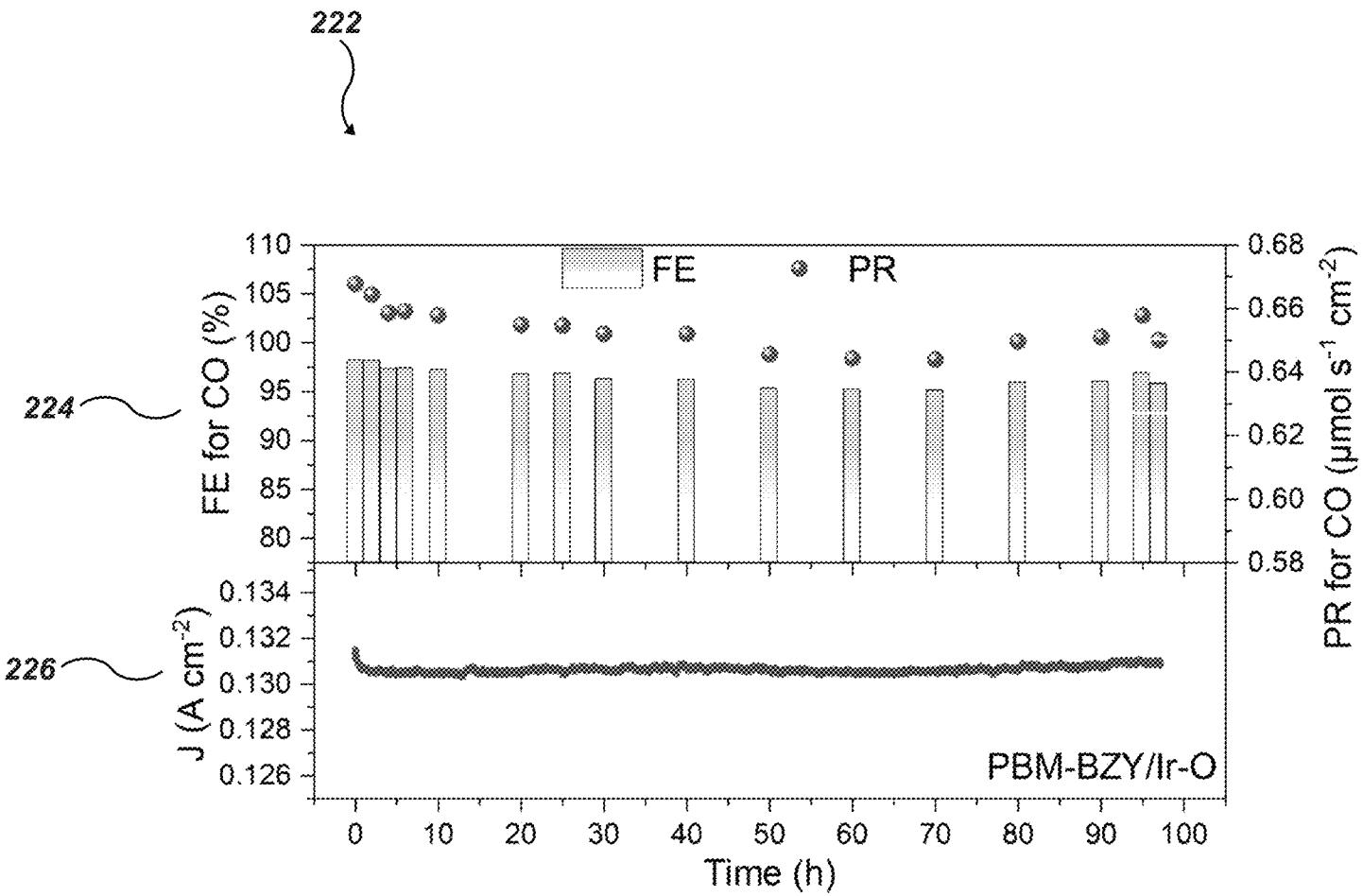

FIGS. 14A and 14B are long-term stability tests of tunable catalysts formed in accordance with embodiments of the disclosure. Tunable catalysts (e.g., PBM-BZY/Ir—Ir and PBM-BZY/Ir—O) in electrochemical cells (e.g., protonic ceramic electrolyzers) were analyzed throughout selective $CO_2$ hydrogenation (e.g., electrohydrogenation). The chronoamperometric technique may be adopted to continuously measure current responses, and the compositions of the cathode effluents may be analyzed by a gas chromatography-mass spectrometry apparatus. The production rates and Faradaic efficiencies may be calculated accordingly. FIGS. 14A and 14B display the long-term performances of two electrochemical cells, PBM-BZY/Ir—Ir 216 and PBM-BZY/Ir—O 222, under a constant bias potential of 0.5 V. The current densities 220, 226 were stabilized in the range of about 136-137 mA $cm^{-2}$ and about 130-131 mA $cm^{-2}$ for PBM-BZY/Ir—Ir 220 and PBM-BZY/Ir—O 226, respectively, and exhibited negligible degradations during the about 100 hour stability tests. For instance, the layered structure of the electrochemical cells was retained throughout the tests. Significantly, the $CH_4$ selectivity 218 and CO selectivity 224 were stabilized in the range of about 92%-96% and about 95%-98% for PBM-BZY/Ir—Ir 216 and PBM-BZY/Ir—O 222, respectively, indicating that the SDC/Ir tunable catalysts of the disclosure may be capable of accomplishing selective $CO_2$ hydrogenation for long periods of time. Thus, tuning the Ir—O hybridization also enables the conversion of $CO_2$ in a durable way, which is not easily accomplished in either aqueous electrochemical cells due to material degradation, or in thermochemical conversion due to carbon deposition on the metal catalysts. The stability tests of FIGS. 14A and 14B, therefore, indicate that the tunable catalysts of the disclosure are comprised of stable metal-oxygen hybridization, which is a key component of effective catalysts.

Figure 15A:
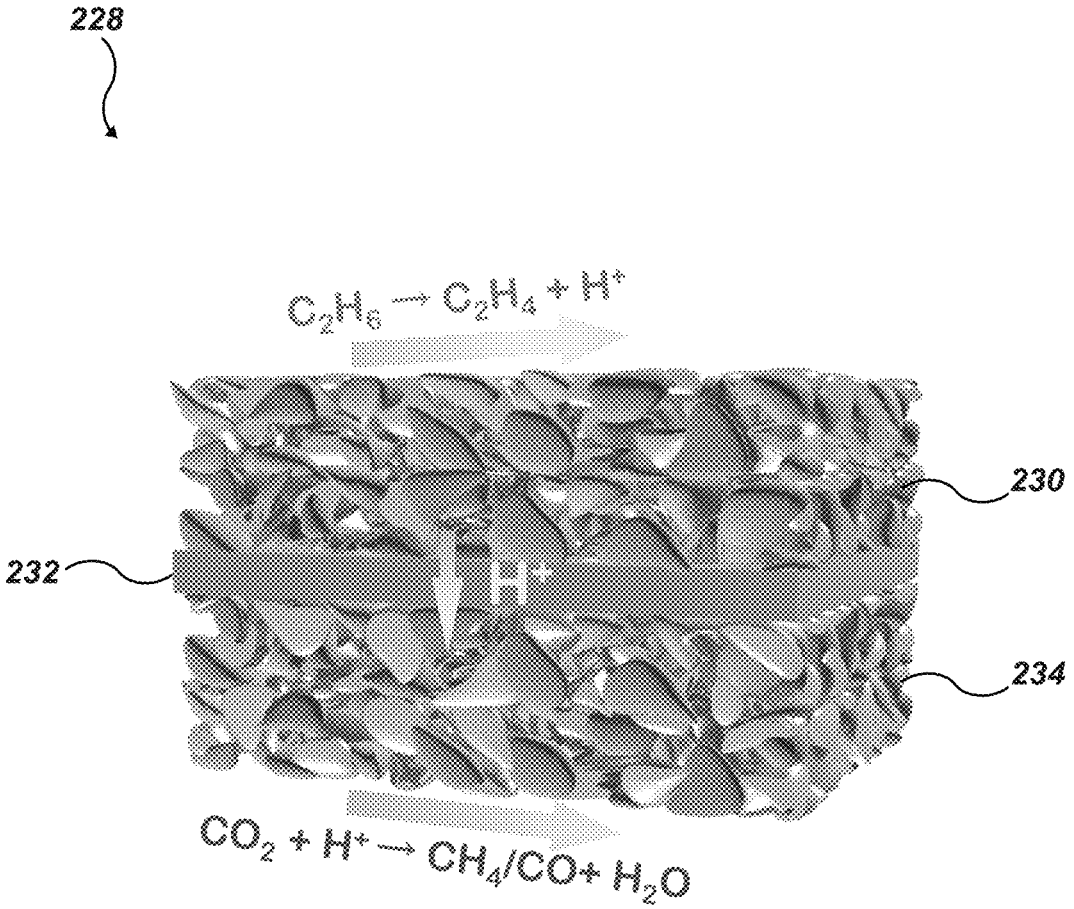
FIG. 15A is a schematic illustration of $CO_2$ hydrogenation in tandem with $C_2H_6$ dehydrogenation in accordance with embodiments of the disclosure.

FIGS. 15A-17B demonstrate the applicability of the tunable catalysts according to embodiments of the disclosure by introducing a highly efficient electrochemical method that couples $CO_2$ hydrogenation and alkanes-to-alkenes dehydrogenation (FIG. 15A). Utilizing this method, a single step green process to convert $CO_2$ in tandem with alkenes production is achieved without using intensive energy input and complex procedures. The synthesized commodity chemicals from both electrodes may be used as fuels or as feedstocks for various chemical syntheses.

Figure 15B:
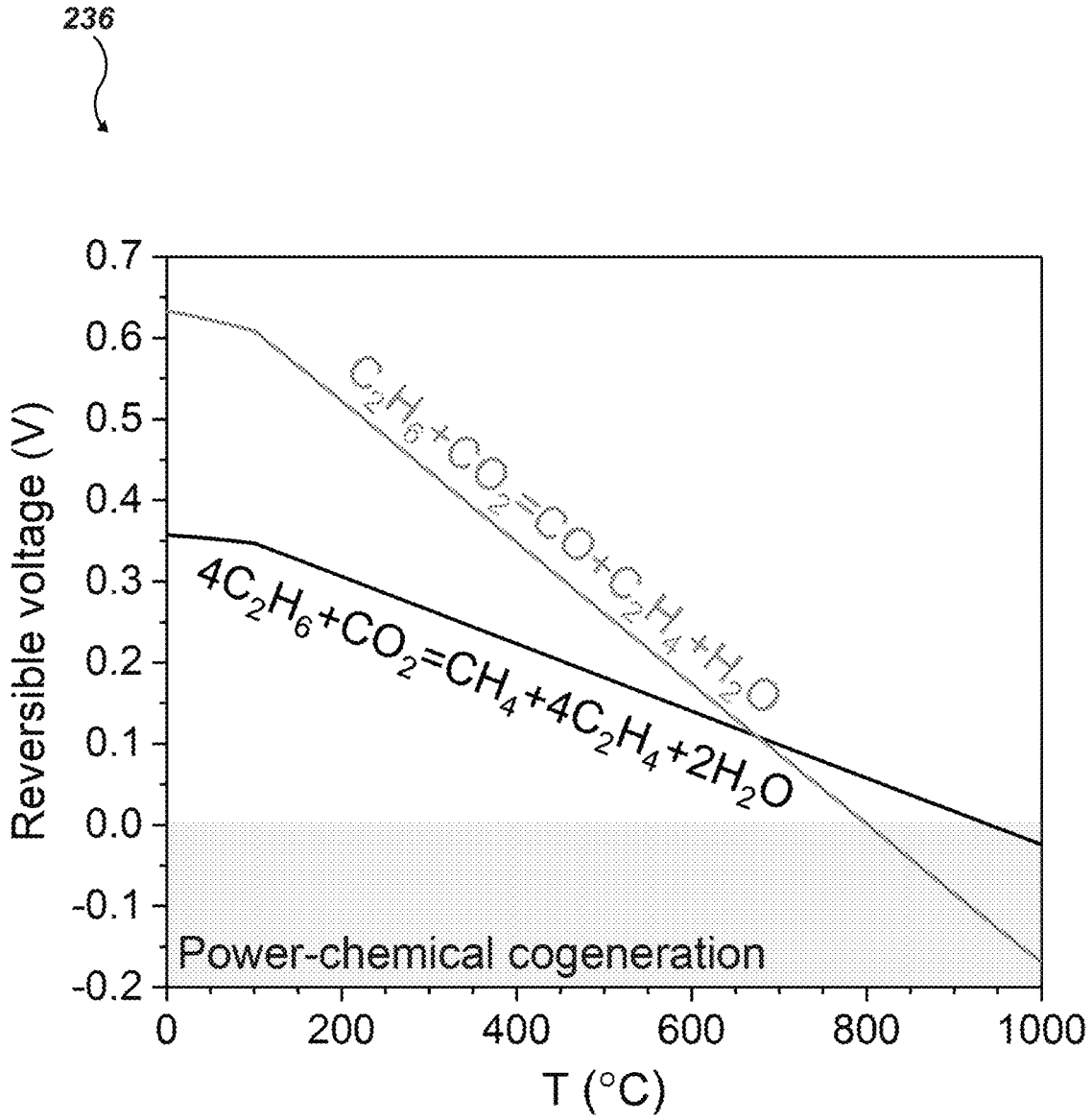
FIG. 15B is a graph illustrating thermodynamic calculations of reversible voltages for methods performed in accordance with embodiments of the disclosure.

FIG. 15A shows a schematic illustration of $CO_2$ hydrogenation in tandem with $C_2H_6$ dehydrogenation 228 in accordance with embodiments of the disclosure. FIG. 15A includes positive electrode 230, membrane 232, and negative electrode 234. FIG. 15B is a graph 236 illustrating the thermodynamic calculations of the $CO_2$ hydrogenation in tandem with $C_2H_6$ dehydrogenation, allowing the temperature to vary while assuming ambient pressure. Only the single step processes according to the following equations were considered in the calculations:

$$CO_2+C_2H_6 \rightarrow CO+H_2O+C_2H_4, \text{ and}$$

$$CO_2+4C_2H_6 \rightarrow CH_4+2H_2O+4C_2H_4.$$

The graph 236 of the thermodynamic calculations indicates that $C_2H_6$ dehydrogenation may proceed at the temperature that $CO_2$ hydrogenation occurs with reasonable electrical energy input. For example, at about 400° C. and about 1 bar, the bias potentials are about 0.223 V for the coproduction of CO and $C_2H_4$, and about 0.348 V for the coproduction of $CH_4$ and $C_2H_4$, respectively, as shown in the graph 236. Although utilizing $H_2$ directly as a proton source may greatly reduce energy input and may even produce a small amount of electricity, industrial $H_2$ production is an energy-intensive process and emits a significant amount of greenhouse gases; thus, using a high energy carrier proton source (e.g., $C_2H_6$) within the electrochemical cell may be advantageous. Moreover, the required energies calculated for the reactions shown in graph 236 are even lower than those for water splitting and $CO_2$ splitting (both of them are above 1 V at 400° C. and 1 bar), suggesting that valuable $CO_2$ conversion products may be obtained from different carbon resources in single step electrochemical cells (e.g., protonic ceramic electrolyzers).

Figure 16A:
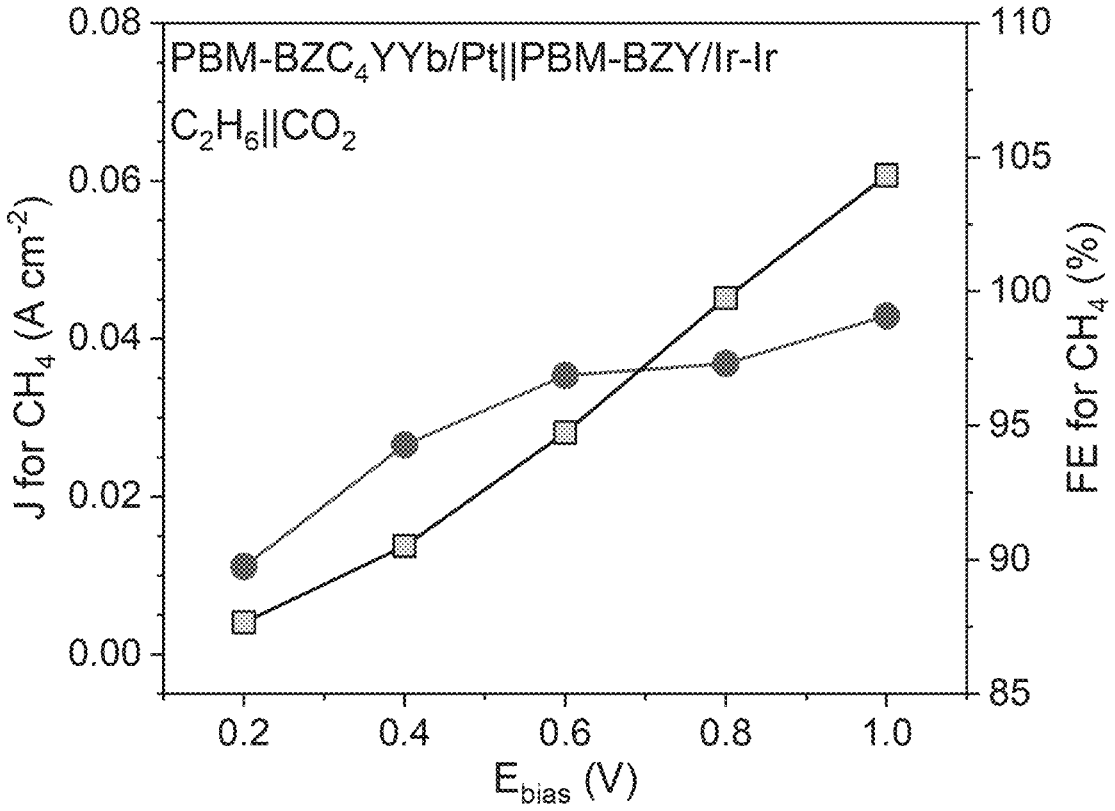
FIG. 16A is a graph of the partial current density and partial Faraday efficiency of $CH_4$ in accordance with embodiments of the disclosure.
Figure 16B:
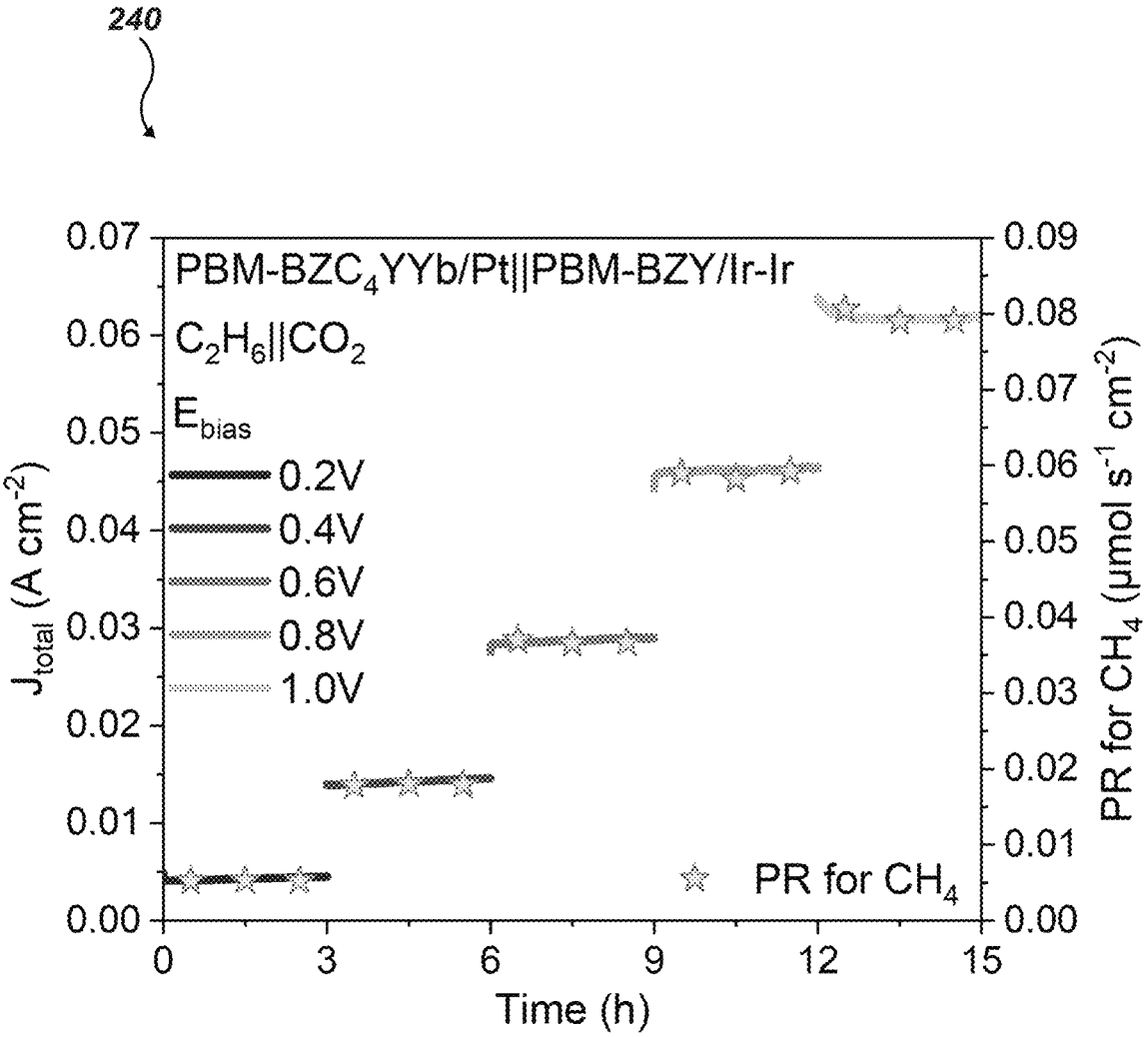
FIG. 16B is a graph of the production rate and short-term stability of $CH_4$ in accordance with embodiments of the disclosure.
Figure 17A:
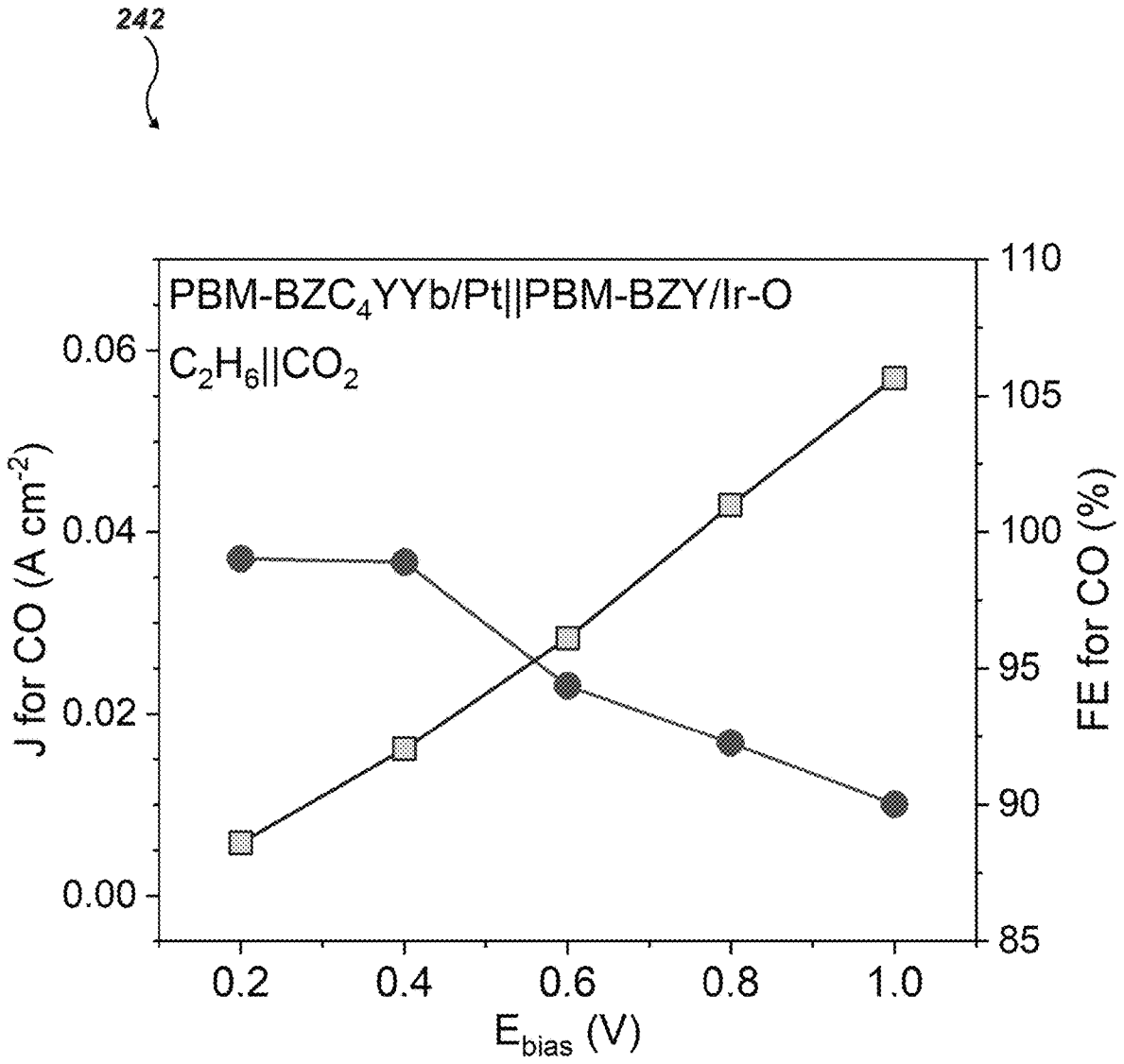
FIG. 17A is a graph of the partial current density and partial Faraday efficiency of CO in accordance with embodiments of the disclosure.
Figure 17B:
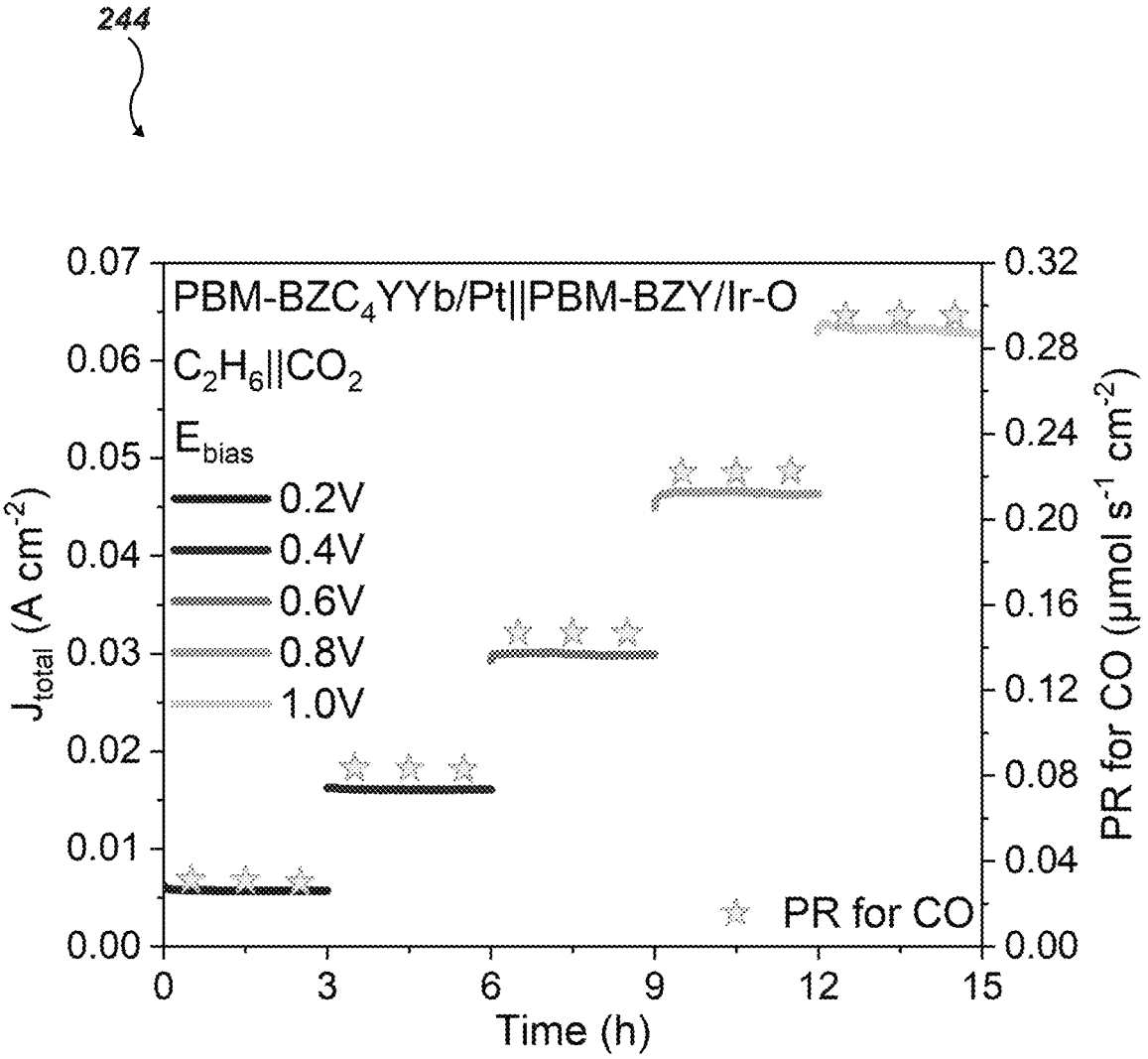
FIG. 17B is a graph of the production rate and short-term stability of CO in accordance with embodiments of the disclosure.

FIG. 16A is a graph of the partial current density and partial Faraday efficiency of $CH_4$ in accordance with embodiments of the disclosure. FIG. 16B is a graph of the production rate and short-term stability of $CH_4$ in accordance with embodiments of the disclosure. FIG. 17A is a graph of the partial current density and partial Faraday efficiency of CO in accordance with embodiments of the disclosure. FIG. 17B is a graph of the production rate and short-term stability of CO in accordance with embodiments of the disclosure.

Referring to FIGS. 16A-17B together, an electrocatalysis survey using the tunable catalysts of the disclosure in electrochemical cells (e.g., PBM-BZY/Ir—Ir and PBM-BZY/Ir—O) shows that the tunable catalysts may be practically used in complex processes (e.g., $CO_2$ hydrogenation in tandem with $C_2H_6$ dehydrogenation). To avoid the carbon deposition of Ni-based electrodes in $C_2H_6$, an alternative PBM-BaZr0.4Ce0.4Y0.1Yb0.1O3-δ (BZ4CYY)/Pt electrode may be produced, where the hybridization between Pt and O may be switched to the metallic Pt by using the complexing agent tailoring method discussed above in order to facilitate the $C_2H_6$ dehydrogenation. The results of these tandem electrochemical processes are shown in FIGS. 16A-17B. By applying electrical currents to the electrochemical cells, $CO_2$-to-$CH_4$ FEs in PBM-BZY/Ir—Ir in graphs 238, 240 and $CO_2$-to-CO FEs in PBM-BZY/Ir—O in graphs 242, 244 are observed between about 90-100% over a broad range (about 0.2 V-1.0 V) in the co-electrochemical mode, as shown in graphs 238 and 242. While the electrolyte in this type of electrochemical cell may be about fifteen times thicker than that used in the previous section (e.g., 202 in FIG. 11), the total current densities measured in the tandem electrochemical tests are greater than one tenth of the previous tests, suggesting good electrochemical performance may be achieved in such a complex electrochemical process. Significantly, the high catalytic activity and characteristic high selectivity towards CO and $CH_4$ observed in the initial tests may be maintained during the stability tests, with the $E_{bias}$ varying from about 0.2 to about 1.0 V, as shown in graphs 240 and 244. Both the production rates for certain hydrocarbon products and the responding total current densities do not change significantly during the 3 hour short-term stability tests at the given bias potentials (shown in graphs 240 and 244), indicating that the electrochemical devices are stable throughout chemical coproduction. The success of co-electrochemical observed in FIGS. 16A-17B indicate that the tunable catalysts and related methods of the disclosure may be generalized to design diverse catalytic and electrocatalytic reactions.

Figure 18:
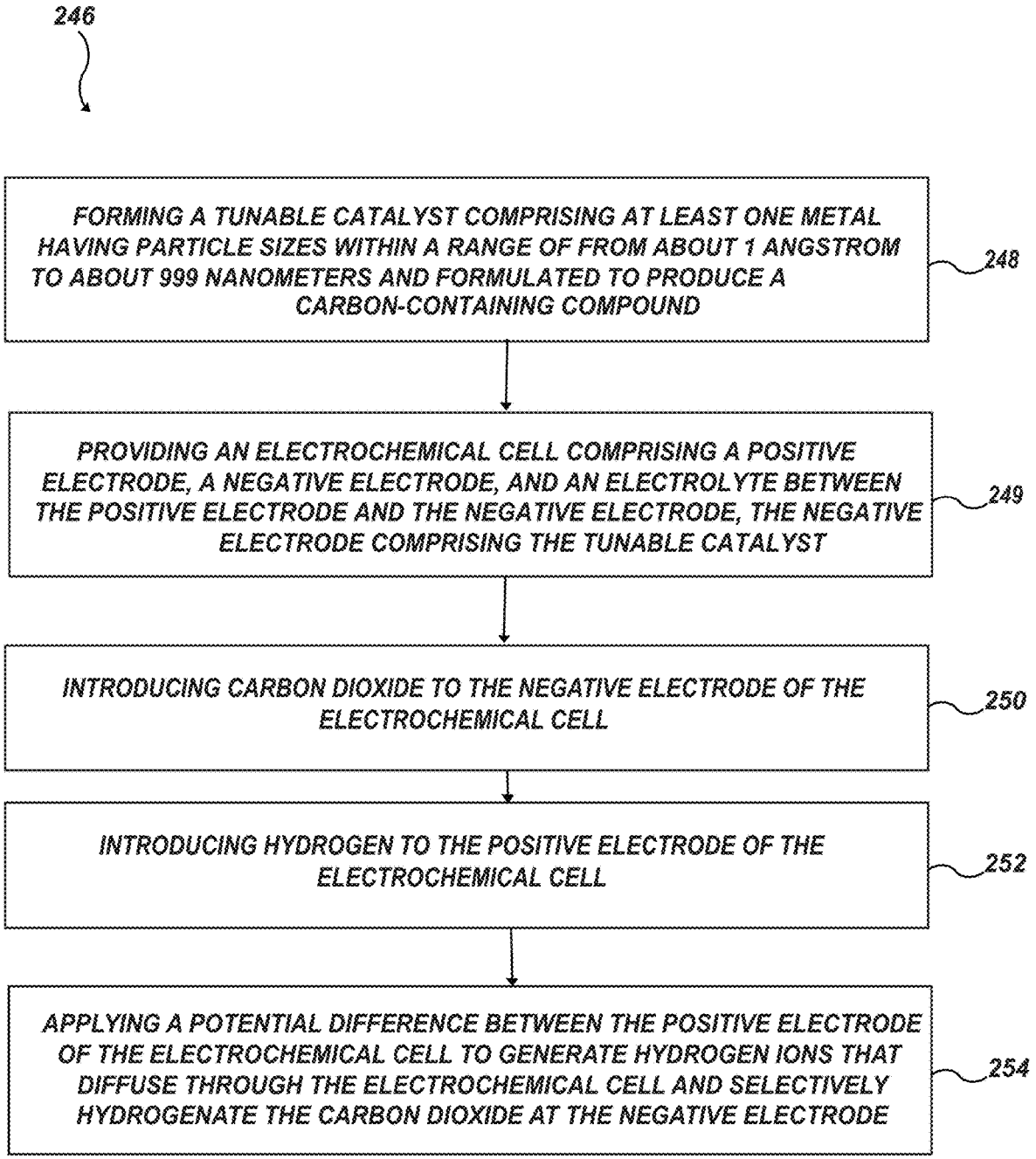
FIG. 18 is a flow chart illustrating a method of carbon dioxide hydrogenation in accordance with embodiments of the disclosure.

Embodiments of the disclosure will now be described with reference to FIG. 18, which is a flow chart illustrating a method 246 of carbon dioxide hydrogenation. As shown in act 248, the method 246 may include forming a tunable catalyst comprising at least one metal having particle sizes within a range from about 1 angstrom to about 999 nanometers and formulated to produce a carbon-containing compound (e.g., at least one carbon-containing compound). The method 246 may further include providing an electrochemical cell that includes a positive electrode (e.g., anode), a negative electrode (e.g., cathode), and an electrolyte between the positive electrode and the negative electrode, where the negative electrode comprises a tunable catalyst, as shown in act 249. The positive electrode, negative electrode, and electrolyte may be comprised of the materials described herein. For example, the negative electrode may include the tunable catalyst according to embodiments of the disclosure. The method 246 may further include introducing carbon dioxide to the negative electrode of the electrochemical cell, as shown in act 250, and may also include introducing hydrogen to the positive electrode of the electrochemical cell, as shown in act 252. The carbon dioxide and hydrogen may be provided from various sources (e.g., greenhouse gas emissions, hydrocarbon fuels, etc.). As shown in act 254, the method 246 may further include applying a potential difference between the positive electrode and the negative electrode of the electrochemical cell to generate hydrogen ions that diffuse through the electrochemical cell and selectively hydrogenate the carbon dioxide at the negative electrode in accordance with embodiments of the disclosure. The carbon dioxide may be selectively hydrogenated into valuable carbonaceous materials (e.g., CO and $CH_4$) through use of the tunable catalysts and related methods of the disclosure.

Figure 19:
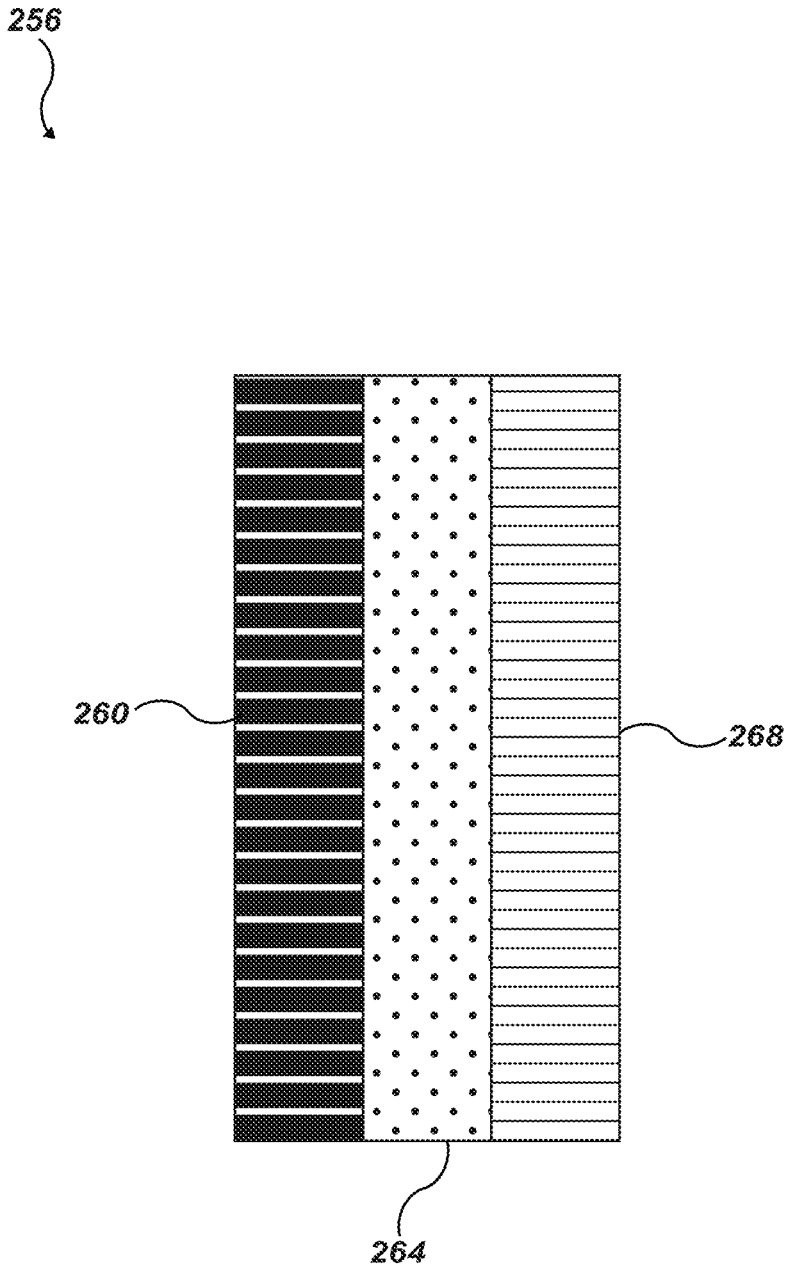
FIG. 19 is a schematic illustration of an electrochemical cell formed in accordance with embodiments of the disclosure.

FIG. 19 is a schematic illustration of an electrochemical cell 256 formed in accordance with embodiments of the disclosure. The electrochemical cell 256 may include a positive electrode 260 (e.g., anode), a negative electrode 268 (e.g., cathode), and an electrolyte 264, where the electrolyte is disposed between the positive electrode and the negative electrode. The negative electrode 268 may comprise the tunable catalyst formulated to selectively hydrogenate $CO_2$ in accordance with embodiments of the disclosure. The tunable catalyst accelerates a reaction rate at the negative electrode 268 of the carbon dioxide to carbon monoxide and/or methane.

The electrolyte 264 may be formed of and include at least one electrolyte material exhibiting an ionic conductivity (e.g., $H^+$ conductivity) greater than or equal to about $10^{-2}$ S/cm (e.g., within a range of from about $10^{-2}$ S/cm to about 1 S/cm) at one or more temperatures within a range of from about 150° C. to about 650° C. (e.g., from about 300° C. to about 500° C.). In addition, the electrolyte material may be formulated to remain substantially adhered (e.g., laminated) to the positive electrode 260 and the negative electrode 268 at relatively high current densities, such as at current densities greater than or equal to about 0.1 amperes per square centimeter ($A/cm^2$) (e.g., greater than or equal to about 0.5 $A/cm^2$, greater than or equal to about 1.0 $A/cm^2$, greater than or equal to about 2.0 $A/cm^2$, etc.). For example, the electrolyte 264 may comprise one or more of a perovskite material, a solid acid material, a polybenzimidazole (PBI) material, and a BZCYYb material (e.g., $BaZr_{0.1}Ce_{0.7}Y_{0.1}Yb_{0.1}O_{3-\delta}$). The material composition of the electrolyte 264 may provide the electrolyte 264 with enhanced ionic conductivity at a temperature within the range of from about 150° C. to about 650° C. as compared to conventional electrolytes (e.g., membranes employing conventional electrolyte materials, such as yttria-stabilized zirconia (YSZ)) of conventional electrochemical cells.

In some embodiments, the electrolyte 264 is formed of and includes at least one perovskite material having an operational temperature (e.g., a temperature at which the $H^+$ conductivity of the perovskite material is greater than or equal to about $10^{-2}$ S/cm, such as within a range of from about $10^{-2}$ S/cm to about $10^{-1}$ S/cm) within a range of from about 350° C. to about 650° C. As a non-limiting example, the electrolyte 264 may comprise one or more of a yttrium- and ytterbium-doped barium-zirconate-cerate (BZCYYb), a yttrium- and ytterbium-doped barium-strontium-niobate (BSNYYb), doped barium-cerate ($BaCeO_3$) (e.g., yttrium-doped $BaCeO_3$ (BCY)), doped barium-zirconate ($BaZrO_3$) (e.g., yttrium-doped $BaCeO_3$ (BZY)), barium-yttrium-stannate ($Ba_2(YSn)O_{5.5}$); and barium-calcium-niobate ($Ba_3(CaNb_2)O_9$). In some embodiments, the electrolyte 264 comprises BZCYYb (e.g., $BaZr_{0.1}Ce_{0.7}Y_{0.1}Yb_{0.1}O_{3-\delta}$ and $BaZr_{0.4}Ce_{0.4}Y_{0.1}Yb_{0.1}O_{3-\delta}$).

As a non-limiting example, the negative electrode 268 may be comprised of a $PrBaMn_2O_{5+\delta}$+$BaZr_{0.7}Y_{0.3}O_{3-\delta}$ (PBM-BZY) cathode. As another non-limiting example, the anode 260 may be comprised of a Ni+$BaZr_{0.1}Ce_{0.7}Y_{0.1}Yb_{0.1}O_{3-\delta}$ (Ni—BZCYYb) anode. Further, one or more of the positive electrode 260 and the negative electrode 268 may include at least one additional catalyst material thereon, thereover, and/or therein. For example, an additional catalyst material may be included on, over, and/or within the material of the positive electrode 260 to accelerate reaction rates within the positive electrode 260 to produce $H^+$ and e− from $H_{2(g)}$. As another example, a catalyst material may be included on, over, and/or within the material of the negative electrode 268 to accelerate reaction rates within the negative electrode 268 to produce a desired product from $H^+$, e−, and one or more of $CO_2$, $CO_2$ hydrogenation product(s), and reaction product(s) of $CO_2$ and/or $CO_2$ hydrogenation product(s) and one or more other materials (e.g., CO and/or $CH_4$). As described throughout the disclosure, the catalyst material of the negative electrode 268 may comprise $Sm_2O_3$-doped-$CeO_2$ (SDC) supported Ir (SDC/Ir) tunable catalysts produced in different particle size ranges. The particle sizes (e.g., the Ir particle sizes) may range from angstroms to microns, and more specifically, from single-atom sizes to nanoparticle sizes. The SDC/Ir tunable catalysts may be introduced into the negative electrode 268 by infiltration and annealing to ensure a high uniformity on the cathodic (e.g., PBM-BZY) scaffold.

In additional embodiments, nano-sized (e.g., having a cross-sectional width or diameter less than about one (1) μm, such as less than or equal to about 100 nanometers (nm), less than or equal to about 20 nm, or less than or equal to about 10 nm) particles (e.g., Ir particles) may be provided on, over, and/or within the negative electrode 268 to promote reaction rates therein.

The positive electrode 260 and the negative electrode 268 may individually exhibit any desired dimensions (e.g., length, width, thickness) and any desired shape (e.g., a cubic shape, cuboidal shape, a tubular shape, a tubular spiral shape, a spherical shape, a semi-spherical shape, a cylindrical shape, a semi-cylindrical shape, a conical shape, a triangular prismatic shape, a truncated version of one or more of the foregoing, and irregular shape) as are conventionally known in the art. For example, the dimensions and the shapes of the positive electrode 260 and the negative electrode 268 may be selected relative to the dimensions and the shape of the electrolyte 264 such that the electrolyte 264 substantially intervenes between opposing surfaces of the positive electrode 260 and the negative electrode 268.

The electrochemical cell 256, including the positive electrode 260, the electrolyte 264, and the negative electrode 268, may be formed through conventional processes (e.g., rolling processes, milling processes, shaping processes, pressing processes, consolidation processes, etc.), which are not described in detail herein. The catalysts included thereon may be formed in accordance with methods of the disclosure. The electrochemical cell 256 may further be utilized as the electrochemical cell 278 described below in FIG. 20.

Figure 20:
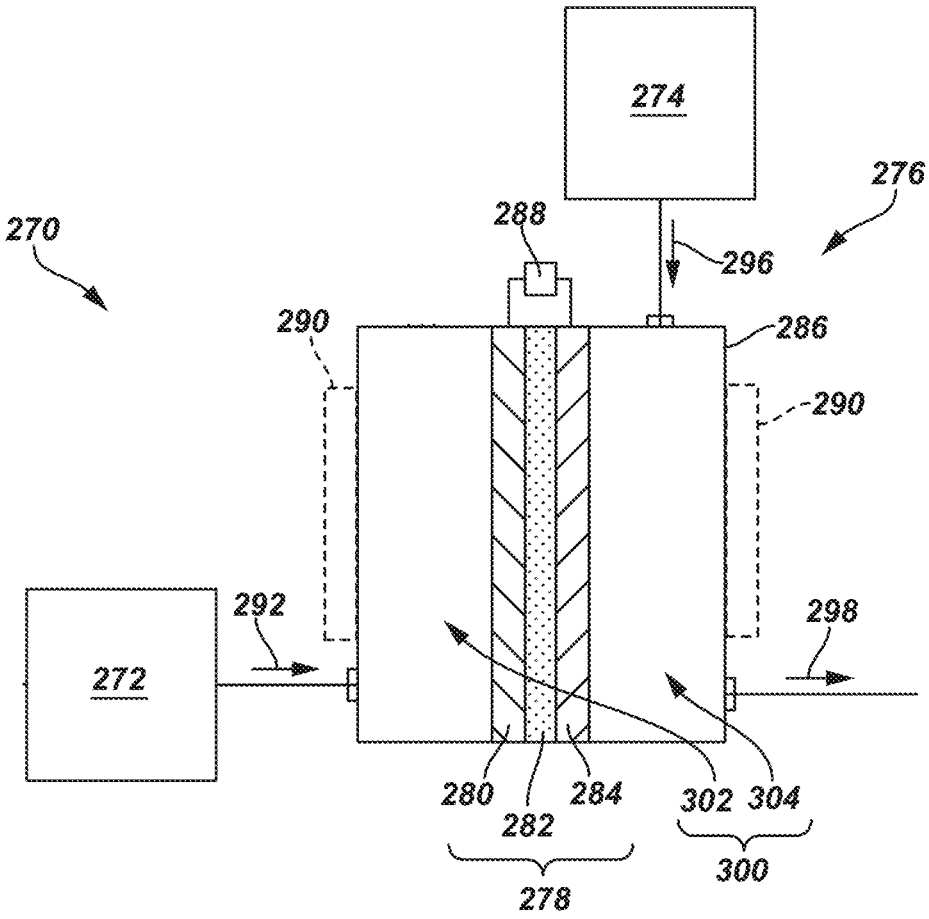
FIG. 20 is a schematic illustration of a carbon dioxide hydrogenation system formed in accordance with embodiments of the disclosure.

FIG. 20 is a schematic illustration of a carbon dioxide hydrogenation system 270 in accordance with embodiments of the disclosure. The $CO_2$ hydrogenation system 270 may be used to convert $H_2$ and $CO_2$ into $H_2O$ and one or more desirable products (e.g., chemical compounds). As shown in FIG. 20, the $CO_2$ hydrogenation system 270 may include at least one $H_2$ source 272 (e.g., containment vessel), at least one $CO_2$ source 274 (e.g., containment vessel), and at least one electrochemical apparatus 276 in fluid communication with each of the $H_2$ source 272, and the $CO_2$ source 274. The electrochemical apparatus 276 includes a housing structure 286, and at least one electrochemical cell 278 contained within the housing structure 286. The electrochemical cell 278 is electrically connected (e.g., coupled) to a power source 288, and includes a positive electrode 280 (e.g., anode), a negative electrode 284 (e.g., cathode), and an electrolyte 282 between the positive electrode 280 and the negative electrode 284. As shown in FIG. 20, the $CO_2$ hydrogenation system 270 may optionally include at least one heating apparatus 290 operatively associated with the electrochemical apparatus 276.

During use and operation, the $CO_2$ hydrogenation system 270 directs the $H_2$ stream 292 (e.g., a gaseous $H_2$ stream) from the $H_2$ source 272 into the electrochemical apparatus 276 to interact with the positive electrode 280 of the electrochemical cell 278. Various hydrogen sources may be used, such as a substantially pure $H_2$ stream, a diluted $H_2$ stream, water, or a hydrocarbon stream. The $H_2$ stream 292 may pass through electrolytes and/or membranes 232 that typically conduct protons. A potential difference (e.g., voltage) is applied between the positive electrode 280 and the negative electrode 284 of the electrochemical cell 278 by the power source 288 so that as the $H_2$ interacts with the positive electrode 280, H atoms of the $H_2$ source release their electrons ($e^-$) and the generated H+ ions permeate (e.g., diffuse) across the electrolyte 282 to the negative electrode 284. At the negative electrode 284, the generated $H^+$ exiting the electrolyte 282 reacts with $CO_2$ delivered into the electrochemical apparatus 276 from the $CO_2$ stream 296 directed from the $CO_2$ source 274, $e^-$ received from the power source 288, and, optionally, one or more other materials (e.g., $CO_2$ hydrogenation products previously formed through reactions between $H^+$, $e^-$, and one or more of $CO_2$ and other $CO_2$ hydrogenation products; reaction products of $CO_2$ and one or more of $CO_2$ hydrogenation products and other molecules delivered to the negative electrode 284 side of the electrochemical cell 278; etc.) to form one or more desirable products (e.g., CO and/or $CH_4$) that then exit the electrochemical apparatus 276 as a product stream 298. By way of example only, the product stream 298 may comprise, consist of, or consist essentially of CO depending on the tunable catalyst used in the negative electrode 284. Alternatively, the product stream 298 may comprise, consist of, or consist essentially of $CH_4$ depending on the tunable catalyst used in the negative electrode 284. The product stream 298 may, alternatively, comprise, consist of, or consist essentially of CO and $CH_4$ at a desired ratio depending on the tunable catalyst used in the negative electrode 284.

As a non-limiting example, the positive electrode 280 (e.g., the Ni—BZCYYb anode of the disclosure) may release electrons from $H_2$ according to the following equation:

$$H_2 \xrightarrow{-2e^-} 2H^+.$$

As another non-limiting example, $CO_2$ may be electrolyzed and hydrogenated in the negative electrode 284 (e.g., the PBM-BZY/X cathode of the disclosure, where X represents an SDC/Ir tunable catalyst of the disclosure) according to the following equations:

$$CO_2 \xrightarrow{2e^-,\ 2H^+} CO + H_2O, \quad \text{or}$$
$$CO_2 \xrightarrow{8e^-,\ 8H^+} CH_4 + 2H_2O.$$

While specific materials for the positive electrode 260, 280, the negative electrode 268, 284, and the electrolyte 264, 282 are described herein, other materials may be used.

The carbonaceous products that may be synthesized (e.g., produced) using the $CO_2$ hydrogenation system 270 according to embodiments of the disclosure are not limited to carbon monoxide, methane, or a combination of carbon monoxide and methane. Rather, it will be readily apparent to one of ordinary skill in the art that the methods and systems described herein may be used to synthesize a wide variety of products through hydrogenation of one or more of $CO_2$, $CO_2$ hydrogenation products, and derivatives of $CO_2$ hydrogenation products. As a non-limiting example, the $CO_2$ hydrogenation system 270 may be used to form one or more of formic acid, formaldehyde, methanol, a formate, a methylated amine, an alcohol other than methanol, a carboxylic acid, a formamide, and an aldehyde, which have the general chemical structures shown below:

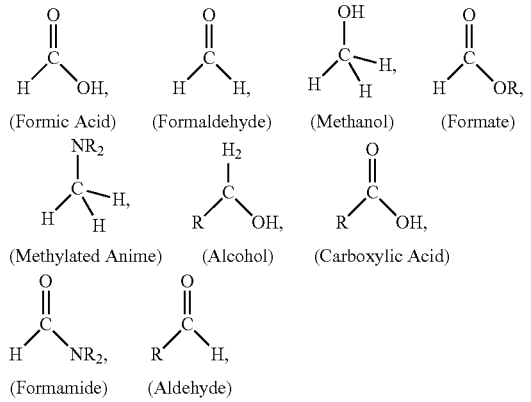

where each R may individually be hydrogen; a substituted or unsubstituted alkyl group (e.g., linear, branched, or cyclic) containing from 1 carbon atom to 10 carbon atoms; or a substituted or unsubstituted aryl group or heteroaryl group. If a group is substituted, the substituent may be an alkyl, alkenyl, alkynyl, alkyl halide, aryl, aryl halide, heteroaryl, non-aromatic ring, $Si(alkyl)_3$, $Si(alkoxy)_3$, alkoxy, amino, ester, amide, thioether, alkylcarbonate, or thioester group.

The $H_2$ stream 292 exiting the $H_2$ source 272 may exhibit any pressure and any flow rate facilitating the hydrogenation of one or more of $CO_2$ from the $CO_2$ stream 296, $CO_2$ hydrogenation products, and/or derivatives of $CO_2$ hydrogenation products (e.g., reaction products of $CO_2$ hydrogenation products and other molecules) within the electrochemical apparatus 276 to synthesize one or more desired products (e.g., one or more commodity chemicals, such as one or more of carbon monoxide, methane, formic acid, formaldehyde, an alcohol, a formate, a methylated amine, a carboxylic acid, a formamide, an aldehyde, etc.). One or more apparatuses (e.g., pumps, compressors, expanders, mass flow control devices, etc.) may be employed within the $CO_2$ hydrogenation system 270 to adjust the pressure(s) and/or flow rate(s) of the $H_2$ stream 292 exiting the $H_2$ source 272.

The $CO_2$ stream 296 entering the electrochemical apparatus 276 may be formed of and include $CO_2$. The $CO_2$ may be present in the $CO_2$ stream 296 in one or more of gaseous phase and a liquid phase. The phase(s) of the $CO_2$ (and, hence, a temperature and a pressure of the $CO_2$ stream 296) may at least partially depend on the operating temperature of the electrochemical cell 278 of the electrochemical apparatus 276. For example, at operating temperatures less than or equal to about 250° C. (e.g., within a range of from about 150° C. to about 250° C.), the $CO_2$ may be present in the $CO_2$ stream 296 in a liquid phase (e.g., $CO_2$ dissolved in an ionic liquid), a gaseous phase, or combination thereof. As another example, at operating temperatures greater than about 250° C. (e.g., greater than about 250° C. and less than or equal to about 650°), the $CO_2$ may be present in the $CO_2$ stream 296 in a gaseous phase. The $CO_2$ stream 296 may only include $CO_2$, or may include $CO_2$ and one or more other materials (e.g., inert materials, materials to be reacted with $CO_2$ hydrogenation products to form desired products, etc.). In some embodiments, the $CO_2$ stream 296 is substantially free of materials other than $CO_2$. One or more apparatuses (e.g., heat exchangers, pumps, compressors, expanders, mass flow control devices, etc.) may be employed within the $CO_2$ hydrogenation system 270 to adjust one or more of the temperature, pressure, and flow rate of the $CO_2$ stream 296 delivered into the electrochemical apparatus 276.

The heating apparatus 290, if present, may comprise at least one apparatus (e.g., one or more of a combustion heater, an electrical resistance heater, an inductive heater, and an electromagnetic heater) configured and operated to heat one or more of the $H_2$ stream 292, the $CO_2$ stream 296, and at least a portion of the electrochemical apparatus 276 to an operating temperature of the electrochemical apparatus 276. The operating temperature of the electrochemical apparatus 276 may at least partially depend on a material composition of the electrolyte 282 of the electrochemical cell 278 thereof. In some embodiments, the heating apparatus 290 heats one or more of the $H_2$ stream 292, the $CO_2$ stream 296, and at least a portion of the electrochemical apparatus 276 to a temperature within a range of from about 150° C. to about 650° C. (e.g., from about 300° C. to about 500° C.). In additional embodiments, such as in embodiments wherein a temperature of the gaseous $H_2$ stream 292 exiting the $H_2$ source 272 is already within the operating temperature range of the electrochemical cell 278 of the electrochemical apparatus 276, the heating apparatus 290 may be omitted (e.g., absent) from the $CO_2$ hydrogenation system 270.

Still referring to FIG. 20, the electrochemical apparatus 276, including the housing structure 286 and the electrochemical cell 278 thereof, is configured and operated to form the product stream 298 including one or more $CO_2$ hydrogenation products (and/or derivatives thereof) from the $H_2$ stream 292 and the $CO_2$ stream 296. The housing structure 286 may exhibit any shape (e.g., a tubular shape, a quadrilateral shape, a spherical shape, a semi-spherical shape, a cylindrical shape, a semi-cylindrical shape, truncated versions thereof, or an irregular shape) and size able to contain (e.g., hold) the electrochemical cell 278 therein, to receive and direct the gaseous $H_2$ stream 292 to the positive electrode 280 of the electrochemical cell 278, to direct the $CO_2$ stream 296 to the negative electrode 284 of the electrochemical cell 278, and to direct the $CO_2$ hydrogenation products (and/or derivatives thereof) formed at the negative electrode 284 of the electrochemical cell 278 away from the electrochemical apparatus 276 as the product stream 298. In addition, the housing structure 286 may be formed of and include any material (e.g., glass, metal, alloy, polymer, ceramic, composite, combination thereof, etc.) compatible with the operating conditions (e.g., temperatures, pressures, etc.) of the electrochemical apparatus 276.

The housing structure 286 may at least partially define at least one internal chamber 300 at least partially surrounding the electrochemical cell 278. The electrochemical cell 278 may serve as a boundary between a first region 302 (e.g., an anodic region) of the internal chamber 300 configured and positioned to receive the $H_2$ stream 292 and to direct the gaseous $H_2O$ stream 124 from the electrochemical apparatus 276, and a second region 304 (e.g., a cathodic region) of the internal chamber 300 configured and positioned receive the $CO_2$ stream 296 and to direct the product stream 298 from the electrochemical apparatus 276. The $H_2$ stream 292 may be substantially limited to the first region 302 of the internal chamber 300 by the configurations and positions of the housing structure 286 and the electrochemical cell 278, such that the second region 304 of the internal chamber 300 is substantially free of $H_2$. Accordingly, the positive electrode 280 may be exposed to the $H_2$ from the $H_2$ stream 292 without exposing the negative electrode 284 to the $H_2$ from the $H_2$ stream 292. Keeping the second region 304 of the internal chamber 300 substantially free of the $H_2$ may circumvent at least some additional processing of the $CO_2$ hydrogenation products (and/or derivatives thereof) that may otherwise be necessary if the $H_2$ was provided within the second region 304 of the internal chamber 300.

As shown in FIG. 20, the positive electrode 280 and the negative electrode 284 of the electrochemical cell 278 are electrically coupled to a power source 288, and the electrolyte 282 is disposed on and between the positive electrode 280 and the negative electrode 284. The electrolyte 282 is configured and formulated to conduct $H^+$ from the positive electrode 280 to the negative electrode 284, while electrically insulating the negative electrode 284 from the positive electrode 280. The electrochemical cell 278 and its components may include any of the components 256-268 described above in regard to FIG. 19. For example, the positive electrode 280 of FIG. 20 may include the positive electrode 260 of FIG. 19, the electrolyte 282 of FIG. 20 may include the electrolyte 264 of FIG. 19, and the negative electrode 284 of FIG. 20 may include the negative electrode 268 of FIG. 19. The positive electrode 280 and the negative electrode 284 may individually be formed of and include at least one material compatible with the material composition of the electrolyte 282 and the operating conditions (e.g., temperature, pressure, current density, etc.) of the electrochemical cell 278, and facilitating the formation of the product stream 298 from the gaseous $H_2$ stream 292 and the $CO_2$ stream 296 at an operational temperature within the range of from about 150° C. to about 650° C. Accordingly, the material compositions of the positive electrode 280 and the negative electrode 284 may be selected to be compatible relative to one another, the material composition of the electrolyte 282, and the operating conditions of the electrochemical cell 278.

Although the electrochemical apparatus 276 is depicted as including a single (i.e., only one) electrochemical cell 278 in FIG. 20, the electrochemical apparatus 276 may include any number of electrochemical cells 278. Put another way, the electrochemical apparatus 276 may include a single (e.g., only one) electrochemical cell 278, or may include multiple (e.g., more than one) electrochemical cells 278 that include the tunable catalysts according to embodiments of the disclosure. If the electrochemical apparatus 276 includes multiple electrochemical cells 278, each of the electrochemical cells 278 may be substantially the same (e.g., exhibit substantially the same components, component sizes, component shapes, component material compositions, component material distributions, component positions, component orientations, etc.) and may be operated under substantially the same conditions (e.g., substantially the same temperatures, pressures, flow rates, etc.), or at least one of the electrochemical cells 278 may be different (e.g., exhibit one or more of different components, different component sizes, different component shapes, different component material compositions, different component material distributions, different component positions, different component orientations, etc.) than at least one other of the electrochemical cells 278 and/or may be operated under different conditions (e.g., different temperatures, different pressures, different flow rates, etc.) than at least one other of the electrochemical cells 278. As a non-limiting example, one of the electrochemical cells 278 may be configured for and operated under a different temperature (e.g., different operating temperature resulting from a different material composition of one or more components thereof, such as a different material composition of the electrolyte 282 thereof) than at least one other of the electrochemical cells 278. In some embodiments, two or more electrochemical cells 278 are provided in parallel with one another within the housing structure 286 of the electrochemical apparatus 276, and may individually produce a portion of the $CO_2$ hydrogenation products (and/or derivatives thereof) directed out of the electrochemical apparatus 276 as the product stream 298.

In addition, although the $CO_2$ hydrogenation system 270 is depicted as including a single (i.e., only one) electrochemical apparatus 276 in FIG. 20, the $CO_2$ hydrogenation system 270 may include any number of electrochemical apparatuses 276. Put another way, the $CO_2$ hydrogenation system 270 may include a single (e.g., only one) electrochemical apparatuses 276, or may include multiple (e.g., more than one) electrochemical apparatuses 276. If the $CO_2$ hydrogenation system 270 includes multiple electrochemical apparatuses 276, each of the electrochemical apparatuses 276 may be substantially the same (e.g., exhibit substantially the same components, component sizes, component shapes, component material compositions, component material distributions, component positions, component orientations, etc.) and may be operated under substantially the same conditions (e.g., substantially the same temperatures, pressures, flow rates, etc.), or at least one of the electrochemical apparatus 276 may be different (e.g., exhibit one or more of different components, different component sizes, different component shapes, different component material compositions, different component material distributions, different component positions, different component orientations, etc.) than at least one other of the electrochemical apparatuses 276 and/or may be operated under different conditions (e.g., different temperatures, different pressures, different flow rates, etc.) than at least one other of the electrochemical apparatuses 276. As a non-limiting example, one of the electrochemical apparatuses 276 may be configured for and operated under a different temperature (e.g., a different operating temperature resulting from a different material composition of one or more components of an electrochemical cell 278 thereof, such as a different material composition of the electrolyte 282 thereof) than at least one other of the electrochemical apparatuses 276. In some embodiments, two or more electrochemical apparatuses 276 are provided in parallel with one another. Each of the two or more electrochemical apparatuses 276 may individually receive an $H_2$ stream 292 and a $CO_2$ stream 296 and individually form a product stream 298. In additional embodiments, two or more electrochemical apparatuses 276 are provided in series with one another. One of the two or more electrochemical apparatuses 276 may receive an $H_2$ stream 292 and a $CO_2$ stream 296 and may form an initial product stream 298 therefrom, and another of the two or more electrochemical apparatuses 276 may receive another $H_2$ stream 292 and the initial product stream 298 (e.g., as a substitute for another $CO_2$ stream 296) and may form another product stream 298 therefrom.

By tuning the hybridization between metal and oxygen orbital states (e.g., Ir and O orbital states), the transportation of species to and from catalytically active sites and the stabilization of specific transition states (e.g., *+CO, *COH and *HCO) may be effectively controlled to tailor the catalytic selectivity of the tunable catalyst. Thus, the precise control of a material's surface chemical environment may enable tailoring of the tunable catalyst's catalytic behavior in the electrochemical process. The tunable catalyst may be used in electrochemical cells and carbon dioxide hydrogenation systems, such as protonic ceramic electrolyzers, to enable on-site $CO_2$ reduction. The methods (e.g., the method 246 of $CO_2$ hydrogenation, etc.), products (e.g., the tunable catalysts comprised of $Sm_2O_3$-doped-$CeO_2$ (SDC) supported Ir (SDC/Ir) produced in different particle size ranges), systems (e.g., the $CO_2$ hydrogenation system 270), and apparatuses (e.g., the electrochemical apparatus 276, including the electrochemical cell 278 thereof, as well as the electrochemical cell 256) of embodiments of the disclosure facilitate simple and efficient $CO_2$ hydrogenation using $CO_2$ electrochemical cells at intermediate temperatures, such as temperatures within a range from about 300° C. to about 650° C. (e.g., from about 300° C. to about 500° C.).

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the following appended claims and their legal equivalent. For example, elements and features disclosed in relation to one embodiment may be combined with elements and features disclosed in relation to other embodiments of the disclosure.

What is claimed is:

1. A method of hydrogenating carbon dioxide, comprising:

forming a tunable catalyst comprising at least one metal comprising a size within a range of from a single atom to about 999 nanometers and formulated to produce one or more carbon-containing compound, the tunable catalyst comprising a transition metal-metal oxide catalyst comprising a $Sm_2O_3$-doped $CeO_2$ supported Ir catalyst;

forming an electrochemical cell comprising a positive electrode, a negative electrode comprising the tunable catalyst, and an electrolyte between the positive electrode and the negative electrode;

introducing carbon dioxide to the negative electrode of the electrochemical cell;

applying a potential difference between the positive electrode and the negative electrode of the electrochemical cell to generate hydrogen ions;

diffusing the hydrogen ions through the electrochemical cell; and hydrogenating the carbon dioxide at the negative electrode to selectively form carbon monoxide, methane, or a combination thereof.

2. The method of claim 1, wherein when the at least one metal of the tunable catalyst comprises from a single metal atom to about 100 metal atoms, hydrogenating the carbon dioxide at the negative electrode comprises selectively forming carbon monoxide at greater than or equal to about 80% relative to the methane.

3. The method of claim 1, wherein when the at least one metal of the tunable catalyst comprises from a single metal atom to about 100 metal atoms, hydrogenating the carbon dioxide at the negative electrode comprises selectively forming carbon monoxide at greater than or equal to about 90% relative to the methane.

4. The method of claim 1, wherein forming a tunable catalyst comprises forming the $Sm_2O_3$-doped $CeO_2$ supported Ir catalyst, the Ir metal in the tunable catalyst comprising a size range of from about 1 Å to about 999 nm.

5. A method of hydrogenating carbon dioxide, comprising:

forming a tunable catalyst comprising $Sm_2O_3$-doped $CeO_2$ supported Ir catalyst and formulated to produce one or more carbon-containing compound;

forming an electrochemical cell comprising a positive electrode, a negative electrode comprising the tunable catalyst, and an electrolyte between the positive electrode and the negative electrode;

introducing carbon dioxide to the negative electrode of the electrochemical cell;

applying a potential difference between the positive electrode and the negative electrode of the electrochemical cell to generate hydrogen ions;

diffusing the hydrogen ions through the electrochemical cell; and hydrogenating the carbon dioxide at the negative electrode at a temperature of from about 300° C. to about 500° C. to selectively form carbon monoxide, methane, or a combination thereof.

6. The method of claim 5, further comprising introducing hydrogen to the positive electrode of the electrochemical cell.

7. The method of claim 6, further comprising forming an alkane at the positive electrode of the electrochemical cell.

8. The method of claim 5, wherein hydrogenating the carbon dioxide at the negative electrode comprises forming a product stream consisting essentially of carbon monoxide.

9. The method of claim 5, wherein hydrogenating the carbon dioxide at the negative electrode comprises forming a product stream consisting essentially of methane.

10. The method of claim 5, wherein diffusing the hydrogen ions through the electrochemical cell comprises diffusing the hydrogen ions across the electrolyte and to the negative electrode.

11. The method of claim 5, wherein introducing carbon dioxide to the negative electrode of the electrochemical cell comprises introducing gaseous carbon dioxide, liquid carbon dioxide, or a combination thereof to the negative electrode of the electrochemical cell.

* * * * *